US006444049B1

(12) United States Patent
Yamashita et al.

(10) Patent No.: US 6,444,049 B1
(45) Date of Patent: Sep. 3, 2002

(54) METHOD FOR PRODUCING HIGH SILICON STEEL, AND SILICON STEEL

(75) Inventors: Osamu Yamashita, Ibaraki; Ken Makita, Osaka; Masao Noumi, Kawanishi; Tsunekazu Saigo, Matsubara, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/463,778

(22) PCT Filed: May 28, 1999

(86) PCT No.: PCT/JP99/02860

§ 371 (c)(1),
(2), (4) Date: Mar. 21, 2000

(87) PCT Pub. No.: WO99/63120

PCT Pub. Date: Dec. 9, 1999

(30) Foreign Application Priority Data

| | | |
|---|---|---|
| May 29, 1998 | (JP) | 10-165981 |
| May 29, 1998 | (JP) | 10-165982 |
| Jun. 26, 1998 | (JP) | 10-196545 |
| Nov. 10, 1998 | (JP) | 10-319525 |

(51) Int. Cl.[7] ..... H01F 1/14; H01F 1/147
(52) U.S. Cl. ..... 148/111; 419/28; 419/29
(58) Field of Search ..... 148/110, 111, 148/112, 307, 308; 419/28, 29

(56) References Cited

U.S. PATENT DOCUMENTS 4,257,830 A * 3/1981 Tsuya et al.
4,299,622 A * 11/1981 Kimira et al. ..... 75/244
4,715,905 A * 12/1987 Nakaoka et al. ..... 148/111
5,413,640 A * 5/1995 Manabe et al. ..... 148/111

FOREIGN PATENT DOCUMENTS

| | | |
|---|---|---|
| JP | 52-153827 | 12/1977 |
| JP | 53-75497 | 7/1978 |
| JP | 54-49934 | 4/1979 |
| JP | 56-38452 | 4/1981 |
| JP | 60-204833 | 10/1985 |
| JP | 2-97606 | 4/1990 |
| JP | 3-229825 | 10/1991 |

* cited by examiner

*Primary Examiner*—John Sheehan
(74) *Attorney, Agent, or Firm*—Dykema Gossett PLLC

(57) ABSTRACT

Manufacture by rolling silicon steel having a silicon content of 3 wt % or greater and by rolling thin sendust sheet is implemented by powder metallurgical fabrication using powder as the starting raw material, and the average crystal grain size of the sheet-form sintered body or quick-cooled steel sheet is made 300 pm or less, whereby intra-grain slip transformation occurs after slip transformation in the grain boundaries, wherefore cold rolling is rendered possible. In addition, a mixture powder wherein pure iron powder and Fe—Si powder are mixed together in a prescribed proportion is fabricated with a powder metallurgy technique, and an iron-rich phase is caused to remain in the sintered body, whereby cold rolling is possible using the plastic transformation of those crystal grains. Furthermore, when a minute amount of a non-magnetic metal element such as Ti, V, or Al, etc., is added beforehand, it becomes easy to make the iron-rich phase and silicon-rich phase enter into solid solution during annealing, crystal grain growth can be promoted, the magnetic properties of the fabricated steel sheet become roughly equivalent to those of conventional ingot material, and silicon steel sheet exhibiting outstanding magnetic properties can be fabricated.

6 Claims, 3 Drawing Sheets

METHOD FOR PRODUCING HIGH SILICON STEEL, AND SILICON STEEL

TECHNICAL FIELD

The present invention relates to improvements in a method of manufacturing high-silicon steel, that is, Fe—Si alloy steel called silicon steel or Fe—Si—Al alloy steel called sendust which has a silicon content of 3 to 10 wt %. More specifically, the present invention relates to a manufacturing method for high-silicon steel that is very difficult to cold-roll into thin sheet, that is, for example, to a method of manufacturing rolled silicon steel sheet by fabricating a sintered body or melt ingot having an average crystal grain size is 300 $\mu$m or smaller, and, by enhancing crystal grain boundary slip, cold-rolling the material as is, or to a manufacturing method for obtaining super-thin sendust sheet by fabricating a thin sheet-form sintered body made up of an iron-rich phase and a silicon-rich Fe—Si solid solution phase, making cold rolling possible using the outstanding malleability of the iron-rich phase crystal grains, then, after cold rolling, causing aluminum to adhere to both sides of the thin sheet and performing heat treatment.

BACKGROUND ART

Currently, almost all of the rolled silicon steel sheet used widely in various applications such as iron cores in transformers and rotating machines, magnetic shielding materials, and electromagnets is manufacturing by repeatedly subjecting silicon steel ingots wherein the silicon content in the iron is 3 wt % or lower to the processes of heat treatment, hot rolling, and annealing.

It is known that permeability is maximized in silicon steel when the silicon content is around 6 wt %, but the rolling of silicon steel sheet wherein the silicon content is 3 wt % or greater in the iron has long been considered very difficult due to fractures occurring during rolling.

In general, the average crystal grain size in melt ingots of silicon steel having a silicon content of 3 wt % or greater in the iron is several mm or greater, and plastic transformation induced by rolling is primarily caused by slip transformation inside the crystal grains.

In cases where the silicon content exceeds 3 wt %, however, the crystal grains themselves become very hard or brittle, wherefore, in silicon steel melt ingots having an average crystal grain size of several mm or greater, cracks readily occur during rolling, irrespective of whether hot rolling or cold rolling is used, and rolling itself becomes virtually impossible.

This is why a method was proposed (K. Narita and M. Enokizono: IEEE. Trans. Magnetic. 14 (1978) 258) for adding magnetic impurities such as magnesium and nickel to make the average crystal grain size in melt ingots more minute. The problem with this method, however, is that these magnetic impurities reduce the magnetic properties of the silicon steel sheet, and so it has not come into wide use.

Another method has been proposed (Y. Takada, M. Abe, S. Masuda and J. Inagaki: J. Appl. Phys. 64 (1988) 5367), and implemented, for manufacturing silicon steel sheet having a desired composition, such as silicon steel sheet having a silicon content of 6.5 wt %, by impregnating the silicon using a CVD (chemical vapor deposition) method after rolling a melt ingot containing 3 wt % silicon in the iron in a conventional process. CVD requires many processes and involves high cost, however, wherefore the applications thereof are naturally limited.

In silicon steel, moreover, when the silicon content is increased, the electrical resistivity ρ of the silicon steel also increases, which is useful in reducing eddy current loss, and is desirable in a soft magnetic material usable in high frequency areas, but this has not been made practical because of the problem of processability noted earlier.

On the other hand, the Fe—Si—Al alloy (sendust) that excels as a soft magnetic material of high permeability is a steel material that ordinarily has a higher silicon content than the silicon steel sheet noted above, and the manufacture of thin sheet thereof has long been considered very difficult due to its great brittleness and hardness.

For this reason, a method has been proposed (H. H. Helms and E. Adams: J. Appl. Phys. 35 (1964) 3) for manufacturing thin sendust sheet of 0.35 mm or so thickness by first fabricating an ingot having lower iron content than the composition required for sendust, pulverizing this, adding iron powder to the pulverized powder to make the required composition, causing the iron powder to act as a binder, and then repeatedly rolling and heat-treating this material.

Methods which employ the powder metallurgy noted above suffer the problem of reduced magnetic properties due to inadequate diffusion of the added element, however, and so have not come into wide use.

For this reason, crystals of sendust having few flaws are fabricated, these are thinly machine-cut, and vapor-deposited by sputtering on a desired substrate to form a sendust thin sheet, the outstanding functioning whereof is used in VCR magnetic heads.

The situation, in other words, is that, conventionally, the volume of sendust thin sheet produced is very small, and the applications thereof are limited, due to the difficulty of mass-production which involves much time and effort.

DISCLOSURE OF THE INVENTION

An object of the present invention is to implement the rolling of silicon steel having a silicon content of 3 wt % or greater which has been conventionally considered impossible. To that end, another object of the present invention is to provide a manufacturing method for rolled silicon steel sheet, and rolled material, wherewith it is possible to easily make the average crystal grain size of the pre-rolled silicon steel sheet more minute, and wherewith the rolled material can be continuously and uniformly cold-rolled, as is, without repeatedly subjecting the silicon ingots to heat treatment, hot rolling, and annealing.

Another object of the present invention is to provide silicon steel wherewith it is possible, without impairing the magnetic properties proper to silicon steel, to sufficiently increase electrical resistivity ρ and reduce eddy current loss.

Another object of the present invention is, in view of the current situation wherein laminated iron cores and the like cannot be configured due to the difficulty of manufacturing sendust thin sheet, to provide a method of manufacturing sendust thin sheet wherewith it is possible to manufacture sendust thin sheet by cold rolling and obtain sendust thin sheet having very outstanding magnetic properties.

The inventors reasoned that cold rolling would be possible, when rolling silicon steel sheet having a silicon content of 3 wt % or greater, by using a sintered body or thin melt sheet having an average crystal grain size made minute for the pre-rolled silicon steel material, and significantly improving grain boundary slip.

Similarly, the inventors reasoned that cold rolling would be made possible by using, for the pre-rolled silicon steel material, a sintered body wherein an iron-rich phase was caused to remain, and causing plastic transformation utilizing the crystal grain malleability exhibited by the iron-rich phase.

The inventors, as a result of various investigations made concerning rolling material for silicon steel exhibiting good cold-rolling characteristics, based on the ideas stated in the foregoing, focused on the average crystal grain size, and made sintered bodies and quick-cooled melts to fabricate silicon steel rolling material having an average crystal grain size of 300 $\mu$m or less, made more minute than conventional silicon steel resulting from slow-cooling melts. They learned that rolling was possible by cold-rolling this, that the effectiveness of making the grain size minute is realized regardless of the silicon content, being particularly effective at and above 3 wt %, and that rolling can be done comparatively easily by making the sheet thickness of the rolling material 5 mm or less and the parallelism 0.5 mm or less.

Similarly, the inventors focused on the composition inside the crystal grains, fabricated sintered silicon steel sheet wherein an iron-rich phase with abundant malleability is caused to remain in a mixed phase having an iron-rich phase and a silicon-rich Fe—Si solid solution phase, unlike the crystal grain of the phase where, with conventional slow-cooling of the melt, iron and silicon are caused to completely become a solid solution, and learned that rolling is possible by cold-rolling this.

The inventors also learned, in terms of the method for manufacturing a sintered body, that it is possible to fabricate a sintered body having the desired minute average crystal grain size by using powder metallurgy techniques to sinter gas-atomized powder or water-atomized powder having a prescribed composition. They further learned, in terms of the powder metallurgy techniques, that it is possible to adopt a method wherein, after molding by metal injection molding, green molding, or slip-cast molding wherein a slurry form of the powder is made to flow in, sintering is done at a prescribed temperature, or a method wherein fabrication is effected by a hot molding method such as hot pressing or plasma sintering, etc.

The inventors further learned, in terms of a method for fabricating thin melt sheet, that a method can be adopted wherewith, in order to make the average crystal grain size as minute as possible, the molten silicon steel is made to flow into a water-cooled casting mold having a thin casting thickness and rapidly cooled.

The inventors also learned, in terms of the composition of the rolling material, that by adding small amounts of Ti, Al, or V, etc., the average crystal grain size at the time of annealing, after rolling, is readily coarsened, that it is possible to completely make the iron-rich phase and silicon-rich phase a solid solution, and that thin rolled silicon steel sheet can thus be obtained that exhibits outstanding magnetic properties wherein the coercive force drops precipitously.

The inventors, having learned of the method of manufacturing rolled silicon steel sheet described in the foregoing, confirmed an increase in electrical resistivity ρ associated with high silicon content. Thereupon, they conducted various investigations on additive elements with the object of finding a material wherewith eddy current loss could be further reduced, and learned that lanthanum is effective. After conducting further investigations, they learned that that, when silicon steel is fabricated with a sintering method, oxides of lanthanum are deposited in the crystal grain boundaries, and that, accordingly, their object can be realized.

The inventors also learned, in terms of a method for depositing the lanthanum oxides in the crystal grain boundaries, that, in addition to the sintering method noted above, that that can be achieved by taking a silicon steel ingot containing lanthanum and subjecting it either to repeated hot rolling or to repeated hot forging.

The inventors, having learned of the method for manufacturing rolled silicon steel sheet described in the foregoing, learned further that, by taking silicon steel sheet obtained by cold-rolling material formed of a sintered body or melt ingot, of silicon steel having a minute average crystal grain size, or silicon sheet obtained by cold rolling, using a sintered body wherein an iron-rich phase is made to remain, and utilizing the grain boundary malleability exhibited by that iron-rich phase, vapor-depositing aluminum under various conditions on both sides thereof and then performing heat treatment, the aluminum diffuses from the surface thereof into the interior, thereby yielding sendust thin sheet having outstanding magnetic properties wherein magnetic permeability is dramatically improved over that of silicon steel sheet.

BEST MODE FOR CARRYING OUT THE INVENTION

The present invention is characterized by the means that it adopts in order to efficiently manufacture silicon steel sheet exhibiting outstanding magnetic properties, namely means for making cold rolling possible by fabricating by powder metallurgy, using powder as the initial raw material, and making the average crystal grain size of a sheet-form sintered body or quick-cooled steel sheet 300 $\mu$m or less, thereby effecting crystal grain boundary slip transformation, and thereafter effecting intra-grain slip transformation, or means for making cold rolling possible by fabricating, by powder metallurgy, a powder mixture wherein pure iron powder and Fi—Si powder are mixed in a prescribed proportion, and causing an iron-rich phase to remain in the sintered body, thereby effecting plastic transformation in the grain boundaries.

Sintered silicon steel resulting from the sintering of silicon steel powder to which lanthanum has been added has a structure wherein lanthanum oxides (containing $La_2O_3$ and non-stoichiometric lanthanum oxides) are deposited in the crystal grain boundaries. This crystal grain boundary phase is formed of highly insulative lanthanum oxides, as a consequence whereof the electrical resistivity ρ or the lanthanum sintered silicon steel becomes greater than in conventional silicon steel.

The radius of the $La^3$+ ion (1.22 Angstroms) is larger than either the radius of the $Fe^3$+ ion (0.67 Angstrom) or the radius of the $Si^4$+ ion (0.39 Angstrom). For that reason, it is believed that lanthanum hardly forms a solid solution at all in the silicon steel matrix, that it is readily deposited in the crystal grain boundaries by sintering, and that it forms lanthanum oxides in the grain boundaries.

While $La^{3}+$ is a rare earth element ion, it does not maintain a magnetic moment, and therefore neither functions as a magnetic impurity nor impairs the magnetic properties of the lanthanum sintered silicon steel. On the contrary, the addition of lanthanum makes the average crystal grains of the sintered silicon steel coarser in the annealing process, and is known also to reduce coercive force.

Figure 1:
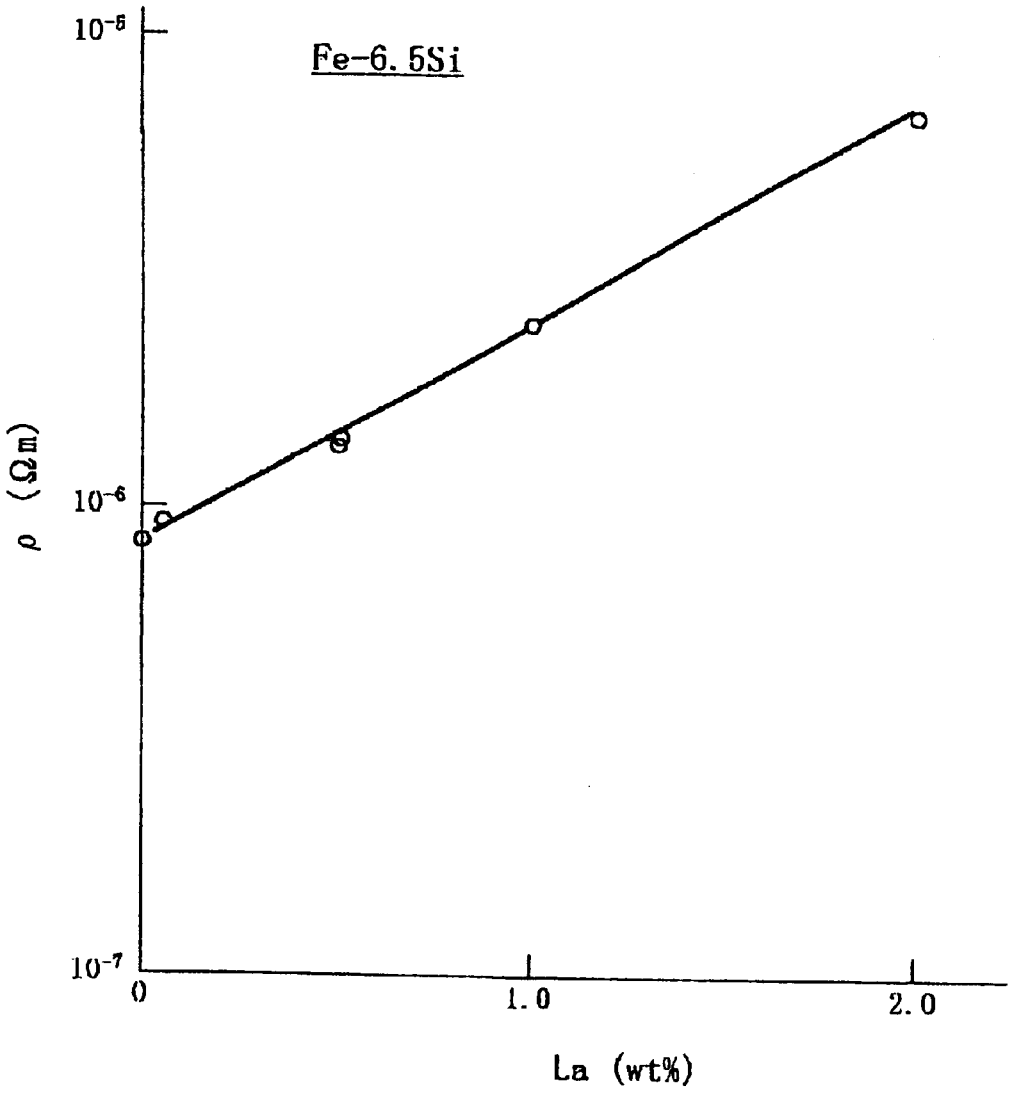
FIG. 1 is a graph plotting the relationship between lanthanum content and the electrical resistivity β of sintered silicon steel wherein the silicon content is 6.5 wt %.

In FIG. 1 is plotted the relationship between lanthanum content and resistivity β when the silicon content is 6.5 wt %. From FIG. 1 it may be seen that a high level of resistivity β is indicated for lanthanum sintered silicon steel, a level that is from several times to nearly ten times that of sintered silicon steel to which lanthanum is not added.

Figure 2:
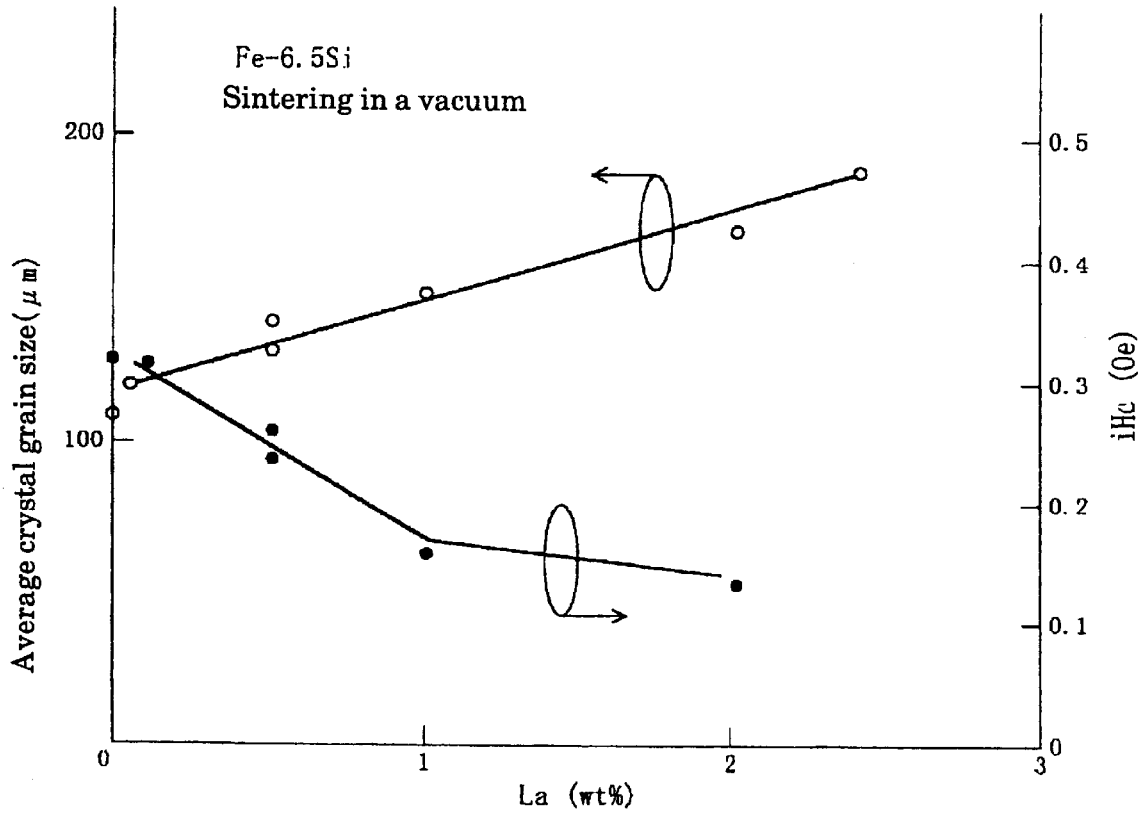
FIG. 2 is a graph plotting the relationship between iHc and lanthanum content, on the one hand, and the average crystal grain size in sintered silicon steel wherein the silicon content is 6.5 wt %, on the other.

In FIG. 2 is plotted the relationship between lanthanum content, on the one hand, and post-sintering average crystal grain size and coercive force iHc, on the other, when the silicon content is 6.5 wt %. From FIG. 2 it may be seen that the lanthanum-containing silicon steel of the present invention has a larger average crystal grain size than does sintered silicon steel to which no lanthanum is added, and that it exhibits outstanding magnetic properties.

Raw Materials Used in Fe—Si Alloy

In the present invention, the silicon steel is characterized by the fact that the composition of the silicon steel material in view is a prescribed composition wherein the silicon content in the iron is from 3 to 10 wt %. That is, because rolling conventionally could not be done with a silicon content of 3 wt % or greater, what is in view in the present invention is to make the silicon content of 3 wt % or greater. However, when 10 wt % is exceeded, the decline in flux density in the material is pronounced, wherefore the range is made 3 to 10 wt %.

A desirable range for lanthanum content is 0.05 wt % to 2.0 wt %. When the lanthanum content is less than 0.05 wt %, the quantity of lanthanum oxides deposited in the grain boundaries is insufficient, and the effect of increasing the electrical resistivity is virtually not evidenced. When the lanthanum content exceeds 2.0 wt %, however, the processability of the silicon steel declines, making it very difficult to fabricate silicon steel sheet by cold rolling. From the perspective of making the resistivity or specific resistance larger, a more preferable range of lanthanum content is 1.0 wt % to 2.0 wt %. The most desirable range for lanthanum content is 1.2 wt % to 1.5 wt %.

For the purpose of realizing magnetic properties, the silicon content in the lanthanum-containing silicon steel should be 3.0 wt % to 10 wt %, but more preferably 5.0 wt % to 8.0 wt %. It is also possible to make the silicon content less than 3.0 wt % in order to obtain silicon steel of high resistivity ρ.

In the present invention, when Ti, Al, and V are added at 0.01 to 1.0 wt % as impurity elements in the silicon steel material, either for the purpose of promoting growth in the crystal grain size during annealing after cold rolling, or for the purpose of making the iron-rich phase and silicon-rich phase a complete solid solution, rolled silicon steel sheet exhibiting good magnetic properties is obtained. The composition and quantities of the additives may be suitably selected according to the application. When the Ti, Al, and V content is less than 0.01 wt %, the grain growth effect is inadequate, whereas when 1.0 wt % is exceeded, the magnetic properties decline, wherefore the range is made 0.01 to 1.0 wt %.

For the raw material here, either gas-atomized powder or water-atomized powder containing the components noted above is suitable in the case of a sintered body, with an average crystal grain size of 10 to 200 μm being desirable. With an average crystal grain size of less than 10 μm, the density of the sintered body is enhanced, but a large volume of oxygen is contained in the powder itself, which tends to cause cracking during cold rolling and also causes a deterioration in magnetic properties.

It is also possible, to use a complex powder wherein silicon powder is mechanically coated onto the surface of the iron powder or other reducing iron powder by a mechanofusion system or the like, or a complex powder that is the reverse thereof, or a complex powder wherein the silicon powder coating the iron powder is further coated with carbonyl iron powder, or, alternatively, a mixed powder wherein Fe—Si compound powder and iron powder are mixed.

When the average crystal grain size of the sintering raw material exceeds 200 μm, the sintered body tends to become porous and the sintering density declines, which also causes cracking during cold rolling. Accordingly, the average crystal grain size should be from 10 to 200 μm. The quantity of oxygen contained in the raw material powder used should be small, the smaller the better, and preferably at least below 1000 ppm.

In the present invention, the method for fabricating the sintered body having the desired minute average crystal grain size requires sintering either gas-atomized powder or water-atomized powder having the composition prescribed in the foregoing, by a powder metallurgy technique.

When the material is fabricated from a melt ingot, if mixing and melting is done so that the composition noted above is realized, there are no particular limitations on the raw material used. It is especially desirable to employ quick cooling, as described below, in order to obtain an average crystal grain size of 300 μm or less. In order to cause lanthanum to be contained, either an Fe—Si—La compound or Fe—Si—$La_2O_3$ is melted and forged into an ingot. After that, the ingot is subjected to repeated hot rolling or repeated hot forging to diffuse the $La_2O_3$ into the grain boundaries.

In the present invention, in order to obtain a sintered body consisting of an iron-rich phase and a silicon-rich Fe—Si solid solution phase, a powder containing more silicon than in the desired composition is desirable for the raw material, either a gas-atomized powder of an Fe—Si compound of a brittle and easily crushed composition, or a mixed powder wherein a carbonyl iron powder is mixed in a prescribed proportion with a powder made by coarse-crushing and then jet-mill pulverizing an ingot having that composition. When the silicon content in the crystalline phase of the sintered body exceeds 6.5 wt % it is called silicon-rich, and when it does not exceed 6.5 wt % it is called iron-rich.

For the Fe—Si compound used, β-phase $Fe_2Si$ compounds, ε-phase FeSi compounds, and ζβ-phase $FeSi_2$ compounds are brittle and easily crushed, and therefore particularly desirable.

It is preferable that the silicon content in the Fe—Si compound be from 20 wt % to 51 wt %. When the silicon content exceeds this range, the compound is very easily oxidized, cracking readily occurs during subsequent cold rolling, and a deterioration in magnetic properties is induced. For the same reason, it is desirable that the lanthanum content be set below 11 wt %.

When the average crystal grain size in the Fe—Si compound powder is less than 3 μm, the powder itself contains a large volume of oxygen, and the sintered body becomes hard or brittle, whereupon cracking readily occurs during cold rolling and the magnetic properties deteriorate. When the average crystal grain size exceeds 100 μm, the sintered body tends to become porous and the sintering density declines, constituting a cause of cracking during cold rolling. Accordingly, the best range for the average crystal grain size is 3 to 100 μm.

For the carbonyl iron powder, on the other hand, anything can be used, but it is preferable to use a commercially marketed powder having a grain size of 3 to 10 μm containing as little oxygen as possible. In any event, the less the oxygen content in the mixed powder of the iron powder and Fe—Si compound powder the better, and that content should preferably be at least below 3000 ppm.

Pre-Rolled Silicon Steel

A powder metallurgy technique can be used in fabricating the sintered body for the rolling material, but it is desirable that that method be one which fabricates a sintered body either by metal injection molding, green molding, or slip casting, etc., or by a hot molding method such as hot pressing or plasma sintering.

More specifically, metal injection molding, green molding, and slip-cast molding are methods wherein silicon steel powder is molded after a binder has been added. After the molding, the binder is removed and sintering is performed. With the hot rolling methods, the raw material powder is placed in a carbon metal mold and simultaneously molded and sintered under pressure while hot (1000° C. to 1300° C.).

In general, silicon steel powder of the stated composition is very readily oxidized due to the silicon content, and is particularly susceptible to oxidation and carbonization when a binder is used in the molding, wherefore binder removal and atmosphere control during sintering are indispensable. Oxidized or carbonized sintered bodies become hard and brittle, moreover, so that cracking occurs when the material is cold-rolled and the magnetic properties after annealing exhibit pronounced deterioration. For these reasons, it is desirable that, the oxygen content and carbon content in the sintered body be below 4000 ppm and below 200 ppm, respectively, and preferably below 2000 ppm and 100 ppm, respectively.

The sintering temperature will differ depending on the composition, average crystal grain size, and molding method, etc., but, in general, sintering should be performed, according to the molding method, in an inert gas atmosphere, in a hydrogen gas atmosphere, or in a vacuum, at a temperature suitably selected between 1100° C. and 1300° C. If deformation during sintering is not prevented to the extent possible, that will cause cracking to develop during cold rolling.

In particular, because an iron-rich phase exhibiting abundant malleability is caused to remain after sintering, it is important that sintering be done at a temperature that is slightly lower than conventional sintering temperatures. Also, because lanthanum is introduced to realize a further increase in the electrical resistivity ρ, it is preferable that the sintering be done at a temperature that is 100° C. or so lower than the sintering temperature used for ordinary silicon steel. If every effort is not made during sintering to prevent deformation during sintering, and parallelism is not realized at 0.5 mm or lower per 50 mm of length, cracking will result during cold rolling.

Figure 3A:
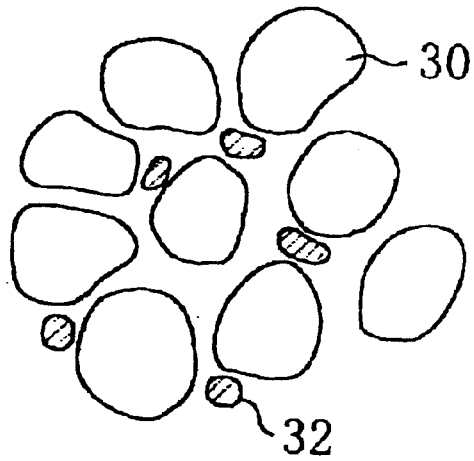
FIG. 3 is a set of cross-sections, with that in FIG. 3A representing in model form the pre-rolling structure of sintered silicon steel containing lanthanum according to the present invention, and that in FIG. 3B representing in model form the structure thereof after annealing.

Sintered silicone steel containing lanthanum has a structure wherein lanthanum oxides 32 are deposited in the grain boundaries of the Fe—Si compound crystal grains 30, as diagrammed in FIG. 3A.

With molten silicon steel material, on the other hand, after being mixed to the prescribed composition and high-frequency melted, the molten silicon steel is made to flow into a water-cooled casting mold having a thin casting thickness of 5 mm or less, quick-cooled, and formed into silicon steel sheet having a minute crystal grain size. It is particularly easy to fabricate the silicon steel material of minute crystal grain size when the thickness is made thin.

Rolling

Silicon steel has the properties of being harder and more brittle than ordinary metals, wherefore it is necessary to change the roller diameter and circumferential speed used in cold rolling depending on the pre-rolled sheet thickness and parallelism. In other words, if the pre-rolled sheet thickness is thick and parallelism is poor, rolling must be done with a small roller size and low circumferential speed.

Conversely, if the sheet thickness is thin and parallelism is good, those conditions can be considerably relaxed. In the case of hot rolling, in particular, the silicon steel sheet becomes susceptible to plastic deformation, so that the roller diameter and circumferential speed conditions can be greatly relaxed as compared to the case of cold rolling. It is effective to perform hot rolling prior to cold rolling, but unless cold rolling is performed finally, thin film rolling is impossible because the surface layer oxidizes and the magnetic properties deteriorate.

In the present invention, the average crystal grain size in the silicon steel is made 300 μm or less and the pre-rolled sheet thickness 5 mm or less. When the thickness of the sintered body exceeds 5 mm, the rolling stress (pulling stress) acts only on the surface and no stress is imposed internally in the sintered body, wherefore cracking occurs. When the thickness is 5 mm or less, however, the stresses imposed on the surface and internally are uniform and rolling is made possible.

In the present invention, in the case of silicon steel sheet containing an iron-rich phase, with silicon steel sheet wherein the pre-rolled sheet thickness is 5 mm or less and the parallelism is 0.5 mm (per 50 mm in length) or less, cold rolling can be performed with no cracking without employing an annealing process during the cold rolling if the roller diameter is 80 mm or less and the roller circumferential speed is 60 mm/sec or less.

In the present invention, if the thickness of the silicon steel sheet is made even thinner at 1 mm or less, the rolling efficiency and thickness dimension precision will be improved by rolling with rollers having a roller diameter that is even smaller, and cracking will be less likely to develop.

When the average crystal grain size of the pre-rolled silicon steel exceeds 300 μm, cracking Develops during rolling irrespective of roller diameter or roller circumferential speed. Also, the fabrication of silicon steel sheet having an average crystal grain size of less than 5 μm is possible only with a powder metallurgical sintering method, which is a method wherein sintering is done with either the sintering temperature lowered or the molding temperature lowered. With either method, however, a sintered body is obtained which has high porosity, wherefore cracking always develops during rolling.

In cases where the iron-rich phase in the silicon steel sheet disappears and complete solid solution is attained, in particular, cracking will develop during rolling irrespective of roller diameter and roller circumferential speed. Also, when the silicon content in the iron exceeds 10 wt %, it becomes difficult to cause the iron-rich phase to remain in the silicon steel sheet, and almost all of it becomes a solid solution, wherefore cracking will always develop during cold rolling.

Also, with the silicon steel sheet rolled with the method of the present invention described in the foregoing, post-rolling machining by cutting machine or punching machine is possible, thereby facilitating the manufacture of products of various shapes.

The rolled silicon steel sheet according to the present invention, unlike ordinary directional silicon steel sheet wherein the (110) face is made the aggregate structure, has the characteristics of directional silicon steel sheet wherein the (100) face is made the aggregate structure.

Annealing

The annealing of the silicon steel sheet according to the present invention is done in order to enhance the magnetic properties after rolling completion, to cause the iron-rich phase and silicon-rich phase to enter completely into a solid solution, and to make the crystal grains coarser. In other words, whereas conventionally the annealing of rolled silicon steel sheet is always performed after rolling a number of times to prevent cracking during rolling, in the present invention, this annealing is done with the aim of coarsening the crystal grain size for the purposes of reducing the crystal grain boundaries that constitute a barrier to magnet wall movement, and reducing coercive force to improve permeability and reduce iron loss.

Figure 3B:
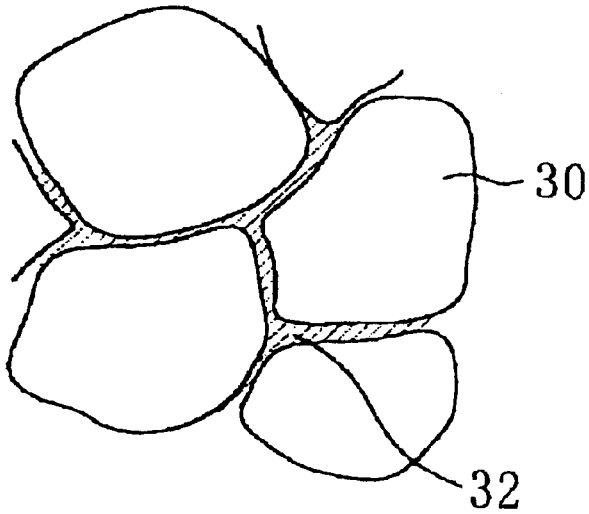

Also, lanthanum sintered silicon steel, after annealing, exhibits a structure, as diagrammed in FIG. 3B, wherein the lanthanum oxides 32 are deposited more abundantly in the grain barriers of the Fe—Si compound crystal grains 30 that have, grown more than prior to annealing.

The temperature for this annealing will differ depending on the rolling ratio (post-rolling sheet thickness/pre-rolling sheet thickness×100(%)) and the average crystal grain size. The annealing temperature is also influenced by non-magnetic element additives and the amounts thereof added. Nevertheless, in the present invention, with an average crystal grain size of 300 $\mu$m or smaller, a temperature range of 1150 to 1250° C. is suitable for rolled steel sheet having a comparatively small average crystal grain size and a high rolling ratio, while, conversely, for rolled steel sheet having a comparatively large average crystal grain size and low rolling ratio, a slightly lower temperature range of 1100 to 1200° C. is suitable.

If this annealing temperature is too high, the crystal grains exhibit an excessive and abnormal growth and the steel sheet becomes very brittle. If, conversely, the temperature is too low, no crystal growth is realized and the magnetic properties are not enhanced. Hence the best temperature range is 1100 to 1250° C. as noted above. The average crystal grain size can be grown to approximately 0.5 to 3 mm by annealing at such temperatures. It has been confirmed that the magnetic properties obtained by this annealing are close to those of ordinary ingot material.

In the case of silicon steel sheet having an iron-rich phase, a temperature range of 1200 to 1300° C. is suitable for rolled steel sheet annealed at low temperature with a high rolling ratio, while, conversely, for rolled steel sheet annealed at high temperature and rolled with a low rolling ratio, a slightly lower temperature range of 1150 to 1250° C. is suitable.

If this annealing temperature is too high, the crystal grains exhibit an excessive and abnormal growth and the steel sheet becomes very brittle. If, conversely, the temperature is too low, the iron-rich phase and silicon-rich phase do not enter into solid solution and no crystal growth is realized, so that the magnetic properties are not enhanced. Hence the best temperature range is the temperature range noted above.

By annealing with the temperatures noted above, the iron-rich phase and silicon-rich phase can be made to completely enter into a solid solution, and the average/crystal grain size thereof can be grown to approximately 0.5 to 3 mm. It has been confirmed that the magnetic properties obtained by this annealing are close to those of ordinary ingot material.

The annealing temperature will also be influenced by the lanthanum content and silicon content. When silicon steel sintered at a comparatively low temperature (1000 to 1100° C., for example) is rolled with a rolling ratio of 70 to 90% or so, the preferable range of annealing temperatures is 1200 to 1300° C. When silicon steel sintered at a comparatively high temperature (1150 to 1250° C., for example) is rolled with a rolling ratio of 50 to 70% or so, on the other hand, the preferable range of annealing temperatures is 1150 to 1250° C. When the annealing temperature is too high, the crystal grains grow abnormally, causing the silicon steel to become very brittle. Conversely, when the annealing temperature is too low, the lanthanum oxide deposition and crystal grain growth become inadequate, wherefore the resistivity $\beta$ and magnetic properties are not sufficiently improved. The annealing time should be appropriately selected within a range of 1 to 5 hours, for example.

Because the lanthanum oxide deposition and crystal grain growth are adequately effected simultaneously by annealing, the resistivity $\rho$ or the lanthanum-containing silicon steel increases to a level close to from several to ten times that realized when no lanthanum is added, and the crystal grain grows to an average crystal grain size of approximately 0.5 to 3 mm. The magnetic properties of the lanthanum-containing silicon steel, moreover, become close to those of ordinary ingot material.

In the present invention, furthermore, the silicon steel sheet, after rolling, can be cut or punched, etc., and products of various shapes can be fabricated according to various applications. Thus the advantage is realized of being able to fabricate, at low cost, silicon steel sheet having good characteristics and high dimensional precision.

Moreover, because the rolled silicon steel sheet of the present invention is directional silicon steel sheet wherein the (100) face is made the aggregate structure, it exhibits great permeability and magnetic flux density as compared to non-directional silicon steel sheet.

The rolled silicon steel sheet, lanthanum-containing sintered silicon steel, and forged silicon steel according to the present invention can be widely used in the various applications in which currently existing soft-magnetic material is used. In addition to being used in the magnetic material pieces at the ends of electromagnets and permanent magnets (pole pieces), these materials are very suitable for use in such applications as MRI yoke elements, transformers, motors, and yokes. Fe—Si—Al Alloy In the present invention, it is desirable that the silicon steel used as a raw material contains 8.3 to 11.7 wt % silicon and, and that the aluminum content be 0 to 2 wt % aluminum as its required composition. In terms of the raw material powder used here, as noted earlier, there is the method of using a mixture powder wherein either iron powder and Fe—Si powder, or iron powder and Fe—Si—Al powder, are mixed in a prescribed proportion, or, alternatively, the method of using an Fe—Si compound or Fe—Si—Al compound powder having the prescribed composition.

For the raw material of the mixture powder noted above, a powder containing more silicon than in the desired composition is desirable, being either a gas-atomized powder of an Fe—Si compound of a brittle and easily crushed composition, or a mixed powder wherein a carbonyl iron powder is mixed in a prescribed proportion with a powder made by crushing and then jet-mill pulverizing an ingot having that composition, or, alternatively, a powder containing more silicon than in the desired composition, being either a gas-atomized powder of an Fe—Si—Al compound of a brittle and easily crushed composition to which a minute amount of aluminum has been added, or a mixed powder wherein a carbonyl iron powder is mixed in a prescribed proportion with a powder made by crushing and then jet-mill pulverizing an ingot having that composition.

For the Fe—Si—(Al) compound used, β-phase $Fe_2Si$ compounds, ϵ-phase Fe—Si compounds, and ζβ-phase $FeSi_2$ compounds are brittle and easily crushed, and are therefore desirable. It is preferable that the silicon content in the Fe—Si compound be from 20 wt % to 51 wt %. When the silicon content is outside of this range, the material is very easily oxidized, and the magnetic properties are caused to deteriorate. It is preferable that the aluminum content in the Fe—Si compound be from 0 to 6.0 wt %. When the aluminum content is outside of this range, cracking readily occurs during cold rolling and oxidation occurs even more readily leading to a deterioration in the magnetic properties.

A range of 3 μm to 100 μm is most desirable for the average crystal grain size in the Fe—Si compound and Fe—Si—Al compound. When the average crystal grain size is less than 3 μm, the powder itself tends to contain a large volume of oxygen, whereupon the magnetic properties deteriorate. When 100 μm is exceeded, on the other hand, the sintered body tends to become porous and the sintering density declines, causing cracking to occur during cold rolling.

The conditions for manufacturing the pre-rolled silicon steel of the sintered body or molted steel using the raw materials noted above are as stated in the foregoing and the rolling conditions are likewise as stated in the foregoing.

The method for impregnating the rolled silicon steel sheet made from the Fe—Si alloy obtained with aluminum is to apply and make a film of the aluminum by vacuum deposition, sputtering, or a CVD method or the like so that the prescribed post-diffusion composition is realized. The quantity of aluminum applied and made into a film is appropriately determined so that the final composition after diffusion becomes 2 to 6 wt % of aluminum, 8 to 11 wt % of silicon, and the remainder iron.

The conditions for the application and film making noted above differ according to the thickness and composition of the rolled silicon steel sheet and the vapor deposition method used, but the aluminum will be more likely to diffuse more evenly, and the magnetic properties more readily enhanced, if direct vapor deposition is imposed on the silicon steel sheet the surface whereof has been cleaned after cold rolling. In other words, because the crystal grain size after rolling is smaller than the crystal grain size after annealing, and residual crystal distortion is greater, the aluminum will more readily diffuse in the grain boundaries.

In addition, the rolled silicon steel sheet according to the present invention, unlike ordinary ,directional silicon steel sheet wherein the (110) face is made the aggregate structure, has the characteristics of directional silicon steel sheet wherein the (100) face is made the aggregate structure, and the rolled surface is not the most dense surface, wherefore an advantage is realized in that diffusion in the crystal grains occurs readily during heat treating after vapor deposition.

The annealing of the silicon steel sheet to which aluminum is applied according to the present invention is performed for the purpose of causing the vapor-deposited aluminum, for example, to diffuse and permeate into the interior of the steel sheet, and to fabricate thin sendust sheet having as uniform a composition as possible.

The annealing heat treatment temperature must be suitably selected according to the composition of the silicon steel sheet, the amount of aluminum applied, and thee average crystal grain size prior to rolling. When the heat treatment is done in a vacuum, this temperature should be set lower, at 1000 to 1100° C., whereas, when the heat treatment is done in an inert gas atmosphere, the temperature should be slightly higher, at 1100 to 1200° C., and, after the aluminum has diffused and permeated, the temperature should be raised to 1200 to 1300° C. and the crystal grain size made coarser in a heat treatment process that follows after the aluminum impregnation heat treatment.

If this annealing temperature is too high in a vacuum, the aluminum will be vaporized from the steel sheet and have difficulty diffusing and permeating. If the temperature after the aluminum has diffused is too high, the crystal grain will exhibit excessive and abnormal growth and the steel sheet will become very brittle. If, contrariwise, the temperature is too low, grain growth will not occur and the magnetic properties will not be improved. Hence the temperature ranges noted above are ideal. The average crystal grain size can be grown to approximately 0.5 to 3 mm by annealing at the temperatures noted above. It has been confirmed that it is possible, by such annealing, to achieve magnetic properties in the thin sendust sheet that are close to those of ordinary ingot material.

Conventionally, sendust alloys, due to their hardness and brittleness, have been considered to be difficult to roll and impossible to make into thin sheet-form material. However, with the present invention, cold rolling is made possible by using, for the starting raw material, either a mixture powder made by mixing either iron powder and Fe—Si powder, or iron powder and Fe—Si—Al powder, in prescribed proportions, or, alternatively, using a powder having the desired composition, and fabricating thin sheet to a thickness of 5 mm or less wherein an iron-rich phase exhibiting abundant malleability is made to remain.

With the present invention, furthermore, after depositing and making a film of aluminum on both sides of the rolled silicon steel sheet as described in the foregoing heat treatment is imposed to effect aluminum diffusion and to coarsen the crystal grain, whereby the magnetic properties for the thin sendust sheet become nearly the same as in conventional ingot material, whereupon thin sendust sheet having outstanding magnetic properties can be fabricated, as has been confirmed.

It is also possible to perform such machining as cutting and punching on the raw-material rolled silicon steel sheet, after it is rolled, so that thin sendust sheet products can be fabricated in various shapes suitable to various applications. Thus the advantage is gained of being able to fabricate, at low cost, thin sendust sheet having high dimensional precision and exhibiting outstanding properties.

EMBODIMENTS

Embodiment 1

Gas-atomized powders of silicon steel having the compositions and average grain sizes given in Table 1 were used for the raw material powder for sintered silicon steel sheet. A PVA (polyvinyl alcohol) binder, water, and plasticizer were added, in the amounts indicated in Table 2, to the raw material powders to make slurries. These slurries were granulated with a completely sealed spray drier apparatus, in nitrogen gas, with the hot gas inlet temperature set at 100° C. and the outlet temperature set at 40° C.

Next, after green-molding the granulated powders having an average grain size of approximately 100 μm with a compression press under a pressure of 2 tons/cm$^2$ to the shapes noted in Table 3, binder removal and sintering at sintering temperatures as noted in Table 3 were performed in a vacuum and in hydrogen to yield sintered bodies having the dimensions noted in Table 4. The residual oxygen amounts, residual carbon amounts, average crystal grain sizes, and relative densities in or of the sintered bodies obtained are listed in Table 4.

After cold-rolling the sintered bodies having the dimensions listed in Table 4 with two-stage rollers having diameters of 60 mm at a roller circumferential speed of 60 mm/sec until a rolling ration of 50% was attained, cold rolling was performed with four-stage rollers having diameters of 20 mm at the same roller circumferential speed, down to 0.10 mm. The rolled conditions are listed in Table 5.

After rolling, furthermore, rings measuring 20 mm Ø×10 mm Ø×0.1 mm t were punched out. These rings were heat treated at the annealing temperatures noted in Table 5, after which the DC magnetic properties and iron loss at a frequency of 5 kHz were measured. The results are listed in Table 6. In terms of the rolled conditions noted in Table 5, ⊚ indicates very good, ○ indicates good, Δ indicates the occurrence of cracking at the end surfaces of the rolled sheet, and X indicates the occurrence of cracking over the entire surface.

Embodiment 2

After high-frequency melting the molten silicon steel of the compositions noted in Table 1, the melts were made to flow into water-cooled casting molds in thin-sheet form having a casting thickness of 5 mm and quick cooling was performed to fabricate steel sheet measuring 50×50×5 mm. Steel sheet cooled slowly without water cooling was also fabricated for comparison. The residual oxygen amounts, residual carbon amounts, average crystal grain sizes, and relative densities of the steel sheet obtained are indicated in Table 4.

Prior to cold rolling, in order to prevent cracking during rolling, steel sheets were prepared from which surface irregularities were removed by processing both sides of the 50×50 mm sheets with a surface grinder. The rolled conditions after that are noted in Table 7, where ○ indicates good and X indicates the occurrence of cracks in the entire surface.

After rolling under the same cold rolling conditions as in the first embodiment, heat treatment was performed at the annealing temperatures listed in Table 7, after which the DC magnetic properties and iron loss at a frequency of 5 kHz were measured. The results are given in Table 8, comparing them with the magnetic properties of a ingot material fabricated without water cooling.

TABLE 1

| Sample No. | Si content (wt %) | Average powder grain size (μm) | Minute composition (wt %) Residual O, C O | C | Metal element Element name | Added amount |
|---|---|---|---|---|---|---|
| Powder raw material | | | | | | |
| 1 | 3.0 | 40 | 0.031 | 0.025 | N/A | — |
| 2 | 6.5 | 30 | 0.043 | 0.025 | N/A | — |
| 3 | 6.5 | 30 | 0.052 | 0.029 | V | 0.02 |
| 4 | 6.5 | 30 | 0.065 | 0.030 | Al | 0.5 |
| 5 | 6.5 | 30 | 0.070 | 0.032 | Ti | 1.00 |
| 6 | 10.0 | 140 | 0.027 | 0.013 | Al | 0.5 |
| Molten raw material | | | | | | |
| 7 | 6.5 | — | 0.004 | 0.001 | Al | 0.5 |

TABLE 2

| | Amount of binder added Polymer | Plasticizer | Water |
|---|---|---|---|
| Embodiment 1 | Polyvinyl alcohol :1.0 wt % | Glycerin :0.1 wt % | Water :54 wt % |

TABLE 3

| No. | Sample No. | Molded body dimensions (mm) | Binder removal conditions Atmosphere | Temperature (° C.) | Time (H) | Sintering conditions Atmosphere | Temperature (° C.) | Time (H) |
|---|---|---|---|---|---|---|---|---|
| Embodiment 1 | | | | | | | | |
| 1 | 1 | 60 × 60 × 1.2 | Vacuum | 500 | 2 | Vacuum | 1200 | 3 |
| 2 | 1 | 60 × 60 × 5.8 | Vacuum | 500 | 2 | Vacuum | 1200 | 3 |
| 3 | 1 | 60 × 60 × 11.8 | Vacuum | 500 | 2 | Vacuum | 1200 | 3 |
| 4 | 2 | 60 × 60 × 1.2 | Vacuum | 500 | 2 | Vacuum | 1200 | 3 |
| 5 | 3 | 60 × 60 × 1.2 | Vacuum | 500 | 2 | Vacuum | 1200 | 3 |
| 6 | 4 | 60 × 60 × 1.2 | Vacuum | 500 | 2 | Vacuum | 1200 | 3 |
| 7 | 5 | 60 × 60 × 1.2 | Vacuum | 500 | 2 | Vacuum | 1200 | 3 |
| 8 | 4 | 60 × 60 × 1.2 | Hydrogen | 500 | 2 | Hydrogen | 1200 | 3 |
| 9 | 4 | 60 × 60 × 5.8 | Vacuum | 500 | 2 | Vacuum | 1200 | 3 |
| 10 | 4 | 60 × 60 × 11.8 | Vacuum | 500 | 2 | Vacuum | 1200 | 3 |

TABLE 3-continued

| No. | Sample No. | Molded body dimensions (mm) | Binder removal conditions Atmosphere | Temperature (° C.) | Time (H) | Sintering conditions Atmosphere | Temperature (° C.) | Time (H) |
|---|---|---|---|---|---|---|---|---|
| 11 | 4 | 60 × 60 × 5.8 | Vacuum | 500 | 2 | Vacuum | 1050 | 3 |
| 12 | 4 | 60 × 60 × 5.8 | Vacuum | 500 | 2 | Vacuum | 1300 | 3 |
| 13 | 6 | 60 × 60 × 5.8 | Vacuum | 500 | 2 | Vacuum | 1150 | 3 |

TABLE 4

| No. | Sample No. | Pre-rolling dimensions (mm) | Parallelism (mm) | Residual oxygen and carbon amounts (wt %) O | C | Average crystal grain size (μm) | Relative density (%) |
|---|---|---|---|---|---|---|---|
| Embodiment 1 | | | | | | | |
| 1 | 1 | 50 × 50 × 1.0 | 0.26 | 0.1100 | 0.004 | 82 | 99 |
| 2 | 1 | 50 × 50 × 5.0 | 0.15 | 0.1150 | 0.004 | 78 | 99 |
| 3 | 1 | 50 × 50 × 10.0 | 0.12 | 0.1150 | 0.004 | 75 | 99 |
| 4 | 2 | 50 × 50 × 1.0 | 0.25 | 0.1200 | 0.005 | 120 | 99 |
| 5 | 3 | 50 × 50 × 1.0 | 0.26 | 0.1200 | 0.005 | 125 | 99 |
| 6 | 4 | 50 × 50 × 1.0 | 0.29 | 0.1400 | 0.005 | 150 | 99 |
| 7 | 5 | 50 × 50 × 1.0 | 0.26 | 0.1600 | 0.005 | 182 | 99 |
| 8 | 4 | 50 × 50 × 1.0 | 0.38 | 0.0750 | 0.001 | 95 | 98 |
| 9 | 4 | 50 × 50 × 5.0 | 0.14 | 0.1200 | 0.005 | 125 | 99 |
| 10 | 4 | 50 × 50 × 10.0 | 0.10 | 0.1150 | 0.005 | 135 | 99 |
| 11 | 4 | 50 × 50 × 5.0 | 0.18 | 0.1200 | 0.005 | 45 | 91 |
| 12 | 4 | 50 × 50 × 5.0 | 0.15 | 0.1600 | 0.005 | 430 | 99 |
| 13 | 6 | 50 × 50 × 5.0 | 0.16 | 0.1400 | 0.006 | 290 | 99 |
| Embodiment 2 | | | | | | | |
| 14 | 7 | 50 × 50 × 5.0 | 0.54 | 0.004 | 0.001 | 240 | 100 |
| 15 | 7 | 50 × 50 × 5.0 | 0.06 | 0.004 | 0.001 | 240 | 100 |
| 16 | 7 | 50 × 50 × 5.0 | 0.06 | 0.004 | 0.001 | 2800 | 100 |

TABLE 5

| No. | Sample No. | Rolled condition | Annealing temperature (° C.) × 3H | Average crystal grain size (μm) |
|---|---|---|---|---|
| Embodiment 1 | | | | |
| 1 | 1 | ◎ | 1250 | 900 |
| 2 | 1 | ◎ | 1250 | 1100 |
| 3 | 1 | Δ | 1250 | 1500 |
| 4 | 2 | ◎ | 1260 | 1000 |
| 5 | 3 | ◎ | 1220 | 1200 |
| 6 | 4 | ◎ | 1200 | 1700 |
| 7 | 5 | ◎ | 1180 | 1400 |
| 8 | 4 | ◎ | 1200 | 1600 |
| 9 | 4 | ◎ | 1230 | 1800 |
| 10 | 4 | Δ | 1260 | 2000 |
| 11 | 4 | X | — | — |
| 12 | 4 | X | — | — |
| 13 | 6 | ○ | 1250 | 2300 |

TABLE 6

| No. | Magnetic properties and iron loss μm | Bs(T) | iHc(Oe) | η(W/kg) | Relative density (%) |
|---|---|---|---|---|---|
| Embodiment 1 | | | | | |
| 1 | 9000 | 1.41 | 0.35 | 21 | 100 |
| 2 | 10000 | 1.43 | 0.31 | 18 | 100 |
| 3 | 12000 | 1.47 | 0.28 | 16 | 100 |
| 4 | 11000 | 1.27 | 0.20 | 17 | 100 |
| 5 | 15000 | 1.25 | 0.18 | 15 | 100 |
| 6 | 18000 | 1.21 | 0.15 | 13 | 100 |
| 7 | 17000 | 1.18 | 0.16 | 14 | 100 |
| 8 | 17000 | 1.21 | 0.16 | 14 | 100 |
| 9 | 17000 | 1.21 | 0.15 | 13 | 100 |
| 10 | 18000 | 1.21 | 0.15 | 13 | 100 |
| 11 | — | — | — | — | — |
| 12 | — | — | — | — | — |
| 13 | 11000 | 1.00 | 0.17 | 21 | 100 |

TABLE 7

| No. | Sample No. | Parallelism (mm) | Rolled condition | Annealing temperature (° C.) × 3H | Crystal grain size after rolling (μm) |
|---|---|---|---|---|---|
| Embodiment 2 | | | | | |
| 14 | 7 | 0.54 | X | — | — |
| 15 | 7 | 0.06 | ○ | 1230 | 1600 |
| 16 | 7 | 0.06 | X | — | — |

TABLE 8

| No. | Magnetic properties and iron loss | | | | Relative density |
|---|---|---|---|---|---|
| | μm | Bs(T) | iHc(Oe) | η(W/kg) | (%) |
| Embodiment 2 | | | | | |
| 14 | — | — | — | — | — |
| 15 | 16000 | 1.18 | 0.1717 | 14 | 100 |
| 16 | — | — | — | — | — |

Embodiment 3

After performing high-frequency melting and forming ingots from raw material powder for sintered silicon steel sheet to form Fe—Si compounds having the compositions noted in Table 9, these were coarse-crushed and then jet-mill pulverized to make powders having the average grain sizes indicated in Table 9.

After mixing the Fe—Si compound powder and carbonyl iron powder in the proportions noted in Table 10, these were mixed with a V cone. A PVA (polyvinyl alcohol) binder, water, and plasticizer were added, in the amounts indicated in Table 11, to the mixed powders to make slurries. These slurries were granulated with a completely sealed spray drier apparatus, in nitrogen gas, with the hot gas inlet temperature set at 100° C. and the outlet temperature set at 40° C.

After green-molding the granulated powders having an average grain size of approximately 100 pm with a compression press under a pressure of 2 tons/cm2 to the shapes noted in Table 12, binder removal and sintering at sintering temperatures as noted in Table 12 were performed in a vacuum and in hydrogen to yield sintered bodies having the dimensions noted in Table 13. The ratios of iron-rich phase content, residual oxygen amounts, residual carbon amounts, and relative densities in or of the sintered bodies obtained are listed in Table 13 . The iron-rich phase content ratio was evaluated relatively according to the ratio between the maximum x-ray diffraction strength characteristic of the Fe—Si compound and the (110) diffraction strength of the silicon steel having a body centered cubic structure (bcc).

After cold-rolling the sintered bodies having the dimensions listed in Table 13 with two-stage rollers having diameters of 60 mm at a roller circumferential speed of 60 mm/sec until a rolling ratio of 50% was attained, cold rolling was performed with four-stage rollers having diameters of 20 mm at the same roller circumferential speed, down to 0.10 mm. The rolled conditions are listed in Table 14. In terms of the rolled conditions noted in Table 14, ◯ indicates very good, ○ indicates good, Δ indicates the occurrence of cracking at the end surfaces of the rolled sheet, and X indicates the occurrence of cracking over the entire surface.

After rolling, furthermore, rings measuring 20 mm ø×10 mm ø×0.1 mm t were punched out. These rings were heat treated at the annealing temperatures noted in Table 14, after which the DC magnetic properties and iron loss at a frequency of 5 kHz were measured. The results are listed in Table 15. The magnetic properties of Fe-6.5Si ingot material are listed in Table 15 to provide an example for comparing magnetic properties.

TABLE 9

| Raw material No. | Silicon content (wt %) | Compound | Average powder grain size (μm) | Minute composition (wt %) Residual O, C O | C | Metal element Element name | Added amount |
|---|---|---|---|---|---|---|---|
| Fe—Si compound powder | | | | | | | |
| 1 | 20.1 | $Fe_2Si(\beta)$ | 6.4 | 0.040 | 0.007 | N/A | — |
| 2 | 33.5 | FeSi(ϵ) | 4.8 | 0.060 | 0.013 | N/A | — |
| 3 | 33.5 | FeSi(ϵ) | 4.9 | 0.060 | 0.014 | V | 0.10 |
| 4 | 33.5 | FeSi(ϵ) | 4.8 | 0.065 | 0.015 | Al | 2.60 |
| 5 | 33.5 | FeSi(ϵ) | 4.8 | 0.080 | 0.018 | Ti | 5.10 |
| 6 | 50.1 | $FeSi_2(\zeta\beta)$ | 3.5 | 0.092 | 0.025 | Al | 3.85 |
| Fe powder | | | | | | | |
| 7 | — | Fe | 5.8 | 0.240 | 0.023 | N/A | — |

TABLE 10

| Sample No | Composition (wt %) Fe | Si | Minute composition Element name | Content (wt %) | Raw material No. | Fe—Si Compound powder and iron powder mixture weights Fe–Si (wt %) | Fe (wt %) |
|---|---|---|---|---|---|---|---|
| Embodiment 3 | | | | | | | |
| 1 | 97 | 3 | N/A | — | 1 | 14.9 | 85.1 |
| 2 | 93.5 | 6.5 | N/A | — | 1 | 32.3 | 67.7 |
| 3 | 93.5 | 6.5 | N/A | — | 2 | 19.4 | 80.6 |

TABLE 10-continued

| Sample | Composition (wt %) | | Minute composition | | Raw | Fe—Si Compound powder and iron powder mixture weights | |
|---|---|---|---|---|---|---|---|
| No | Fe | Si | Element name | Content (wt %) | material No. | Fe–Si (wt %) | Fe (wt %) |
| 4 | 93.5 | 6.5 | V | 0.02 | 3 | 19.4 | 80.6 |
| 5 | 93.5 | 6.5 | Al | 0.50 | 4 | 19.4 | 80.6 |
| 6 | 93.5 | 6.5 | Ti | 1.00 | 5 | 19.4 | 80.6 |

TABLE 10-continued

| Sample | Composition (wt %) | | Minute composition | | Raw | Fe—Si Compound powder and iron powder mixture weights | |
|---|---|---|---|---|---|---|---|
| No | Fe | Si | Element name | Content (wt %) | material No. | Fe–Si (wt %) | Fe (wt %) |
| 7 | 93.5 | 6.5 | Al | 0.50 | 6 | 14.9 | 85.1 |
| 8 | 90 | 10 | N/A | — | 6 | 20.0 | 80.0 |

TABLE 11

| | Amount of binder added | | |
|---|---|---|---|
| | Polymer | Plasticizer | Water |
| Embodiment 3 | Polyvinyl alcohol :0.5 wt % | Glycerin :0.1 wt % | Water :54 wt % |

TABLE 12

| No. | Sample No. | Molded body dimensions (mm) | Binder removal conditions Atmosphere | Temperature (° C.) | Time (H) | Sintering conditions Atmosphere | Temperature (° C.) | Time (H) |
|---|---|---|---|---|---|---|---|---|
| Embodiment 3 | | | | | | | | |
| 1 | 1 | 60 × 60 × 1.2 | Vacuum | 500 | 2 | Vacuum | 1100 | 2 |
| 2 | 1 | 60 × 60 × 5.8 | Vacuum | 500 | 2 | Vacuum | 1100 | 2 |
| 3 | 1 | 60 × 60 × 11.8 | Vacuum | 500 | 2 | Vacuum | 1100 | 2 |
| 4 | 2 | 60 × 60 × 1.2 | Vacuum | 500 | 2 | Vacuum | 1050 | 2 |
| 5 | 3 | 60 × 60 × 1.2 | Vacuum | 500 | 2 | Vacuum | 1040 | 2 |
| 6 | 4 | 60 × 60 × 1.2 | Vacuum | 500 | 2 | Vacuum | 1030 | 2 |
| 7 | 5 | 60 × 60 × 1.2 | Vacuum | 500 | 2 | Vacuum | 1200 | 2 |
| 8 | 5 | 60 × 60 × 1.2 | Vacuum | 500 | 2 | Vacuum | 950 | 2 |
| 9 | 5 | 60 × 60 × 1.2 | Vacuum | 500 | 2 | Vacuum | 1000 | 2 |
| 10 | 6 | 60 × 60 × 1.2 | Vacuum | 500 | 2 | Vacuum | 1000 | 2 |
| 11 | 6 | 60 × 60 × 1.2 | Hydrogen | 500 | 2 | Hydrogen | 1000 | 2 |
| 12 | 7 | 60 × 60 × 1.2 | Vacuum | 500 | 2 | Vacuum | 1000 | 2 |
| 13 | 3 | 60 × 60 × 5.8 | Vacuum | 500 | 2 | Vacuum | 1040 | 2 |
| 14 | 3 | 60 × 60 × 11.8 | Vacuum | 500 | 2 | Vacuum | 1040 | 2 |
| 15 | 8 | 60 × 60 × 1.2 | Vacuum | 500 | 2 | Vacuum | 1000 | 2 |
| 16 | 8 | 60 × 60 × 5.8 | Vacuum | 500 | 2 | Vacuum | 1000 | 2 |

TABLE 13

| No. | Raw material No. | Pre-rolling dimensions (mm) | Parallelism (mm) | Residual oxygen and carbon amounts (wt %) O | C | X-ray diffraction strength ratio | Relative sintering density (%) |
|---|---|---|---|---|---|---|---|
| Embodiment 3 | | | | | | | |
| 1 | 1 | 50 × 50 × 1.0 | 0.32 | 0.1500 | 0.005 | 0.012 | 96 |
| 2 | 1 | 50 × 50 × 5.0 | 0.17 | 0.1500 | 0.005 | 0.012 | 96 |
| 3 | 1 | 50 × 50 × 10.0 | 0.14 | 0.1500 | 0.005 | 0.012 | 96 |
| 4 | 2 | 50 × 50 × 1.0 | 0.34 | 0.1400 | 0.006 | 0.024 | 95 |
| 5 | 3 | 50 × 50 × 1.0 | 0.35 | 0.1600 | 0.008 | 0.020 | 95 |
| 6 | 4 | 50 × 50 × 1.0 | 0.31 | 0.1600 | 0.008 | 0.018 | 96 |
| 7 | 5 | 50 × 50 × 1.0 | 0.29 | 0.1700 | 0.008 | 0.001 | 99 |
| 8 | 5 | 50 × 50 × 1.0 | 0.30 | 0.1700 | 0.008 | 0.086 | 87 |
| 9 | 5 | 50 × 50 × 1.0 | 0.34 | 0.1700 | 0.008 | 0.014 | 96 |
| 10 | 6 | 50 × 50 × 1.0 | 0.23 | 0.1800 | 0.008 | 0.017 | 95 |
| 11 | 6 | 50 × 50 × 1.0 | 0.25 | 0.0840 | 0.001 | 0.017 | 95 |

TABLE 13-continued

| No. | Raw material No. | Pre-rolling dimensions (mm) | Parallelism (mm) | Residual oxygen and carbon amounts (wt %) O | C | X-ray diffraction strength ratio | Relative sintering density (%) |
|---|---|---|---|---|---|---|---|
| 12 | 7 | 50 × 50 × 1.0 | 0.33 | 0.1900 | 0.010 | 0.025 | 94 |
| 13 | 3 | 50 × 50 × 5.0 | 0.17 | 0.1600 | 0.008 | 0.017 | 96 |
| 14 | 3 | 50 × 50 × 10.0 | 0.13 | 0.1600 | 0.008 | 0.018 | 96 |
| 15 | 8 | 50 × 50 × 1.0 | 0.37 | 0.1900 | 0.013 | 0.045 | 95 |
| 16 | 8 | 50 × 50 × 5.0 | 0.20 | 0.1900 | 0.013 | 0.043 | 95 |

TABLE 14

| No. | Raw material No. | Rolled condition | Annealing temperature (° C.) × 3H | Average crystal grain size (μm) |
|---|---|---|---|---|
| Embodiment 3 | | | | |
| 1 | 1 | ◎ | 1200 | 1000 |
| 2 | 1 | ○ | 1250 | 1200 |
| 3 | 1 | X | — | — |
| 4 | 2 | ◎ | 1260 | 1100 |
| 5 | 3 | ◎ | 1220 | 1300 |
| 6 | 4 | ◎ | 1200 | 1900 |
| 7 | 5 | X | — | — |
| 8 | 5 | X | — | — |
| 9 | 5 | ◎ | 1200 | 1800 |
| 10 | 6 | ◎ | 1200 | 1700 |
| 11 | 6 | ◎ | 1200 | 1600 |
| 12 | 7 | ◎ | 1280 | 2000 |
| 13 | 3 | ○ | 1250 | 1800 |
| 14 | 3 | X | — | — |
| 15 | 8 | ◎ | 1220 | 2300 |
| 16 | 8 | ○ | 1250 | 2500 |
| Comparison | | | | |
| Fe-6.5Si | | Ingot material | — | 3600 |

TABLE 15

| No | Raw material No. | Magnetic properties and iron loss (η) μm | Bs(T) | iHc(Oe) | η(W/kg) | Relative density (%) |
|---|---|---|---|---|---|---|
| Embodiment 3 | | | | | | |
| 1 | 1 | 9000 | 1.41 | 0.35 | 21 | 100 |
| 2 | 1 | 11000 | 1.43 | 0.32 | 18 | 100 |
| 3 | 1 | — | — | — | — | — |
| 4 | 2 | 10000 | 1.24 | 0.21 | 18 | 100 |
| 5 | 3 | 13000 | 1.23 | 0.19 | 16 | 100 |
| 6 | 4 | 16000 | 1.21 | 0.16 | 14 | 100 |
| 7 | 5 | — | — | — | — | — |
| 8 | 5 | — | — | — | — | — |
| 9 | 5 | 17000 | 1.21 | 0.16 | 14 | 100 |
| 10 | 6 | 16000 | 1.21 | 0.16 | 14 | 100 |
| 11 | 6 | 15000 | 1.21 | 0.17 | 15 | 100 |
| 12 | 7 | 17000 | 1.22 | 0.15 | 13 | 100 |
| 13 | 3 | 16000 | 1.21 | 0.15 | 14 | 100 |
| 14 | 3 | — | — | — | — | — |
| 15 | 8 | 10000 | 1.00 | 0.19 | 20 | 100 |
| 16 | 8 | 11000 | 1.00 | 0.18 | 22 | 100 |

TABLE 15-continued

| No | Raw material No. | Magnetic properties and iron loss (η) μm | Bs(T) | iHc(Oe) | η(W/kg) | Relative density (%) |
|---|---|---|---|---|---|---|
| Comparison | | | | | | |
| Fe-6.5Si | | 16000 | 1.22 | 0.14 | 14 | 100 |
| | | | | | | 100 |
| | | | | | | 100 |

Embodiment 4

The Fe—Si—La compound powders having the compositions and average grain sizes noted in Table 16 were used for the lanthanum sintered silicon steel raw material powder. These Fe—Si—La compound powders were first melted by high-frequency melting lanthanum and the Fe—Si compounds noted in Table 16 and made into alloy ingots. The ingots were coarse-crushed and then jet-mill pulverized. The carbonyl iron powders having the composition and average grain size noted in Table 16 were used for the iron powder. The β, ϵ, and ζβ symbols in the "Compound" column in Table 16 indicate the type of crystal.phase in the Fe—Si compound.

Next, the Fe—Si—La compound powder and iron powder were mixed in the proportions indicated in Table 17 and mixed together in a V cone. Raw materials No. 8 and No. 9 in Table 17 contain no lanthanum and are given as comparison examples.

To the mixture powders so obtained were added a PVA (polyvinyl alcohol) binder, water, and plasticizer, in the amounts indicated in Table 11, to make slurries. These slurries were granulated with nitrogen gas, using a completely sealed spray drier apparatus, with the hot gas inlet temperature set at 100° C. and the outlet temperature set at 75° C. The average grain size of the granulated powders was approximately 80 μm.

Next, the granulated powders noted above were green-molded using a compression press under a pressure of 2 tons/cm$^2$. The dimensions of the moldings produced are given in Table 18. Sintering was then performed under the binder removing conditions and sintering temperature conditions noted in Table 18, in a vacuum and in hydrogen, yielding the sintered bodies having the dimensions indicated in Table 19. The residual oxygen amounts, residual carbon amounts, average crystal grain sizes, and relative densities of the sintered bodies are noted in Table 19. In Table 20 are noted the results of evaluating the rolled condition, annealing temperatures, average crystal grain sizes of rolled silicon steel sheet, DC magnetic properties, DC resistivity ρ, and measured densities. The symbols in the "Rolled Condition" column are the same as those used in the first embodiment.

Also given in Table 20, as comparison examples, are the results of evaluating the properties of an ingot material of silicon steel having a silicon content of 3.0 wt % and of an ingot material of silicon steel having a silicon content of 6.5 wt %.

TABLE 16

| Raw material No. | Silicon content (wt %) | Compound | Average powder grain size (μm) | Minute composition (wt %) Residual O, C O | C | Metal element Element name | Added amount |
|---|---|---|---|---|---|---|---|
| Fe—Si—La compound powder | | | | | | | |
| 1 | 20.1 | $Fe_2Si(\beta)$ | 6.4 | 0.040 | 0.070 | La | 0.67 |
| 2 | 33.5 | FeSi(ϵ) | 4.9 | 0.060 | 0.014 | La | 0.26 |
| 3 | 33.5 | FeSi(ϵ) | 4.8 | 0.065 | 0.015 | La | 2.63 |
| 4 | 33.5 | FeSi(ϵ) | 4.8 | 0.080 | 0.018 | La | 5.25 |
| 5 | 33.5 | FeSi(ϵ) | 4.5 | 0.105 | 0.029 | La | 10.5 |
| 6 | 33.5 | FeSi(ϵ) | 4.1 | 0.116 | 0.035 | La | 12.9 |
| 7 | 50.1 | $FeSi_2(\zeta\beta)$ | 3.5 | 0.092 | 0.025 | La | 3.85 |
| Fe—Si powder | | | | | | | |
| 8 | 20.1 | $Fe_2Si(\beta)$ | 6.6 | 0.038 | 0.007 | N/A | — |
| 9 | 33.5 | FeSi(ϵ) | 4.8 | 0.060 | 0.013 | N/A | — |
| Fe powder | | | | | | | |
| 10 | — | Fe | 5.8 | 0.240 | 0.023 | N/A | — |

Note: The β, ϵ, and ζβ symbols in the parentheses () in the "Compound" column indicate the type of crystal phase in the Fe–Si compound.

TABLE 17

| Sample No | Composition (wt %) Fe | Si | La content (wt %) | Fe—Si—La compound powder and iron powder mixture weights Raw Material No. | Fe—Si—La (wt %) | Fe (wt %) |
|---|---|---|---|---|---|---|
| Embodiment 4 | | | | | | |
| 1 | 97 | 3 | 0.1 | 1 | 14.9 | 85.1 |
| 2 | 93.5 | 6.5 | 0.05 | 2 | 19.4 | 80.6 |
| 3 | 93.5 | 6.5 | 0.50 | 3 | 19.4 | 80.6 |
| 4 | 93.5 | 6.5 | 1.0 | 4 | 19.4 | 80.6 |
| 5 | 93.5 | 6.5 | 2.0 | 5 | 19.4 | 80.6 |
| 6 | 93.5 | 6.5 | 2.4 | 6 | 19.4 | 80.6 |
| 7 | 90 | 10 | 0.77 | 7 | 20.0 | 80.0 |
| Comparison | | | | | | |
| 8 | 97 | 3 | 0.0 | 8 | 14.9 | 85.1 |
| 9 | 93.5 | 6.5 | 0.0 | 9 | 19.4 | 80.6 |

TABLE 18

| No. | Sample No. | Molded body dimensions (mm) | Binder removal conditions Atmosphere | Temperature (° C.) | Time (H) | Sintering conditions Atmosphere | Temperature (° C.) | Time (H) |
|---|---|---|---|---|---|---|---|---|
| Embodiment 4 | | | | | | | | |
| 1 | 1 | 60 × 60 × 1.2 | Vacuum | 500 | 2 | Vacuum | 500 | 2 |
| 2 | 2 | 60 × 60 × 1.2 | Vacuum | 500 | 2 | Vacuum | 500 | 2 |
| 3 | 3 | 60 × 60 × 1.2 | Vacuum | 500 | 2 | Vacuum | 500 | 2 |
| 4 | 3 | 60 × 60 × 5.8 | Vacuum | 500 | 2 | Vacuum | 500 | 2 |
| 5 | 3 | 60 × 60 × 11.8 | Vacuum | 500 | 2 | Vacuum | 500 | 2 |
| 6 | 3 | 60 × 60 × 1.2 | Hydrogen | 500 | 2 | Hydrogen | 500 | 2 |
| 7 | 4 | 60 × 60 × 1.2 | Vacuum | 500 | 2 | Vacuum | 500 | 2 |
| 8 | 5 | 60 × 60 × 1.2 | Vacuum | 500 | 2 | Vacuum | 500 | 2 |

TABLE 18-continued

| No. | Sample No. | Molded body dimensions (mm) | Binder removal conditions Atmosphere | Temperature (° C.) | Time (H) | Sintering conditions Atmosphere | Temperature (° C.) | Time (H) |
|---|---|---|---|---|---|---|---|---|
| 9 | 6 | 60 × 60 × 1.2 | Vacuum | 500 | 2 | Vacuum | 500 | 2 |
| 10 | 7 | 60 × 60 × 1.2 | Vacuum | 500 | 2 | Vacuum | 500 | 2 |
| Comparison | | | | | | | | |
| 11 | 8 | 60 × 60 × 1.2 | Vacuum | 500 | 2 | Vacuum | 500 | 2 |
| 12 | 9 | 60 × 60 × 0.6 | Vacuum | 500 | 2 | Vacuum | 500 | 2 |
| 13 | 9 | 60 × 60 × 1.2 | Vacuum | 500 | 2 | Vacuum | 500 | 2 |

TABLE 19

| Sample No. | Raw material No. | Pre-rolling dimensions (mm) | Parallelism (mm) | Residual oxygen and carbon amounts (wt %) O | C | Average crystal grain size (μm) | Relative sintering density (° C.) |
|---|---|---|---|---|---|---|---|
| Embodiment 4 | | | | | | | |
| 1 | 1 | 50 × 50 × 1.0 | 0.35 | 0.1700 | 0.005 | 82 | 98 |
| 2 | 2 | 50 × 50 × 1.0 | 0.38 | 0.1700 | 0.006 | 120 | 96 |
| 3 | 3 | 50 × 50 × 1.0 | 0.32 | 0.2200 | 0.008 | 140 | 96 |
| 4 | 3 | 50 × 50 × 5.0 | 0.18 | 0.2100 | 0.008 | 140 | 96 |
| 5 | 3 | 50 × 50 × 10.0 | 0.14 | 0.2000 | 0.008 | 130 | 96 |
| 6 | 3 | 50 × 50 × 1.0 | 0.37 | 0.0860 | 0.002 | 200 | 97 |
| 7 | 4 | 50 × 50 × 1.0 | 0.33 | 0.2500 | 0.009 | 150 | 96 |
| 8 | 5 | 50 × 50 × 1.0 | 0.42 | 0.2800 | 0.010 | 170 | 96 |
| 9 | 6 | 50 × 50 × 1.0 | 0.39 | 0.3100 | 0.012 | 190 | 96 |
| 10 | 7 | 50 × 50 × 1.0 | 0.48 | 0.2400 | 0.008 | 90 | 96 |
| Comparison | | | | | | | |
| 11 | 8 | 50 × 50 × 1.0 | 0.37 | 0.1500 | 0.005 | 74 | 98 |
| 12 | 9 | 50 × 50 × 0.5 | 0.63 | 0.2100 | 0.005 | 95 | 97 |
| 13 | 9 | 50 × 50 × 1.0 | 0.34 | 0.1800 | 0.005 | 110 | 97 |

TABLE 20

| Sample No. | Raw material No. | Rolled conditions | Annealing temperature (° C.) | Average crystal grain size (μm) | Magnetic properties and electrical resistivity μm | Bs (T) | iHc (Oe) | ρ × $10^{-7}$ (Ωm) | Relative density (%) |
|---|---|---|---|---|---|---|---|---|---|
| Embodiment 4 | | | | | | | | | |
| 1 | 1 | ◎ | 1150 | 1000 | 8000 | 1.40 | 0.37 | 3.8 | 100 |
| 2 | 2 | ◎ | 1200 | 1300 | 11000 | 1.41 | 0.32 | 9.4 | 100 |
| 3 | 3 | ◎ | 1200 | 1500 | 11000 | 1.39 | 0.26 | 13.2 | 100 |
| 4 | 3 | ○ | 1200 | 1600 | 11000 | 1.38 | 0.24 | 13.5 | 100 |
| 5 | 3 | X | — | — | — | — | — | — | — |
| 6 | 3 | ◎ | 1170 | 2000 | 12000 | 1.38 | 0.20 | 13.2 | 100 |
| 7 | 4 | ◎ | 1250 | 2400 | 14000 | 1.34 | 0.16 | 24.2 | 100 |
| 8 | 5 | ◎ | 1250 | 2800 | 15000 | 1.32 | 0.14 | 68.2 | 100 |
| 9 | 6 | X | — | — | — | — | — | — | — |
| 10 | 7 | ◎ | 1250 | 2500 | 11000 | 1.00 | 0.17 | 20.2 | 100 |
| Comparison | | | | | | | | | |
| 11 | 8 | ◎ | 1150 | 850 | 6500 | 1.40 | 0.45 | 2.9 | 100 |
| 12 | 9 | X | — | — | — | — | — | — | — |
| 13 | 9 | ◎ | 1200 | 1200 | 11000 | 1.43 | 0.32 | 8.6 | 100 |

TABLE 20-continued

| Sintered Body Cold-Rolled Conditions and Post-Annealing Magnetic Properties | | | | | | | | | |
|---|---|---|---|---|---|---|---|---|---|
| | Raw | | Annealing | Average crystal | Magnetic properties and electrical resistivity | | | | Relative |
| Sample No. | material No. | Rolled conditions | temperature (° C.) | grain size (μm) | μm | Bs (T) | iHc (Oe) | $\rho \times 10^{-7}$ (Ωm) | density (%) |
| Comparison | | | | | | | | | |
| Fe-3.0Si | | Ingot material | — | 2700 | 9800 | 1.43 | 0.35 | 2.1 | 100 |
| Fe-6.5Si | | Ingot material | — | 3600 | 18000 | 1.42 | 0.14 | 7.2 | 100 |

Note: The annealing temperature noted is the optimum heat-treatment temperature.

Embodiment 5

For the raw material powder for sintered silicon steel sheet, high-frequency melting was done and ingots were made to form the Fe—Si compounds and Fe—Si—Al compounds noted in Table 21. These ingots were then coarse-crushed and jet-mill pulverized to make powders having the average grain sizes noted in Table 21.

For the steel powder, carbonyl iron powder having the composition and average grain size noted in Table 21 was used. The Fe—Si compounds or Fe—Si—Al compounds were mixed with the carbonyl iron powder in the proportions noted in Table 22 and then mixed together in a V cone.

For the powders of the desired composition, moreover, gas-atomized powders having the compositions and average grain sizes noted in Table 23 were used. To the raw material powders were added a PVA (polyvinyl alcohol) binder, water, and plasticizer, in the amounts indicated in table 24, to make slurries. These slurries were pulverized with a completely sealed spray drier apparatus, using nitrogen gas, with the hot gas inlet temperature set at 100° C. and the outlet temperature set at 40° C.

After green-molding the granulated powders having an average grain size of approximately 80 μm with a compression press under a pressure of 2 tons/cm$^2$ to the shapes noted in Table 25, binder removal and sintering at sintering temperatures as noted in Table 26 were performed in a vacuum to yield sintered bodies having the dimensions noted in Table 26. The parallelism (in Table 26), residual oxygen amounts, residual carbon amounts, average crystal grain sizes, and relative densities in or of the sintered bodies obtained are listed in Table 27.

After cold-rolling the sintered bodies having the dimensions listed in Table 26 with two-stage rollers having outer diameters of 60 mm at a roller circumferential speed of 60 mm/sec until a rolling ration of 50% was attained, cold rolling was performed with four-stage rollers having outer diameters of 20 mm at the same roller circumferential speed, down to the thicknesses indicated ink Table 28. The rolled conditions are listed in Table 28.

After rolling, 20 Ø×10 Ø rings were punched out, aluminum was vacuum-deposited on both sides of the steel sheet in the thicknesses noted in Table 29, heat treatment was performed at the annealing temperatures indicated in Table 29, and the DC magnetic properties were measured. The results are noted in Table 30. The rolled conditions noted in Table 28 are the same as in the first embodiment.

Embodiment 6

After high-frequency melting molten silicon steel having the compositions noted in Table 23, this was made to flow into a water-cooled thin-sheet-form casting mold having a thickness of 5 mm and then made into quick-cooled 50×50×5 mm steel sheet as well as steel sheet slow-cooled without quick cooling. The residual oxygen amounts, residual carbon amounts, average crystal grain sizes, and relative densities of the steel sheet obtained are noted in Table 27.

Prior to cold rolling, in order to prevent cracking during rolling, steel sheet was prepared from which surface irregularities were removed by processing both 50×50 mm sides with a surface grinder (embodiment No. 18 and No. 19). A steel sheet was also prepared on which no grinding was done (embodiment No. 17). These were rolled to the thicknesses indicated in Table 28 under the same cold rolling conditions as in Embodiment 1. The results are noted in Table 28.

After rolling, 20 Ø×10 Ø rings were punched out, aluminum was vapor deposited on both sides of the steel sheet to the thicknesses indicated in Table 29, heat treatment was performed at the annealing temperatures indicated in Table 29, and the DC magnetic properties were measured. The results are noted in Table 30 in comparison with the magnetic properties of the ingot material without water cooling.

As an example for magnetic property comparison, the magnetic properties of ordinary Fe-6.5Si and sendust alloy ingot material are noted in Table 30

TABLE 21

| Raw material No. | Silicon content (wt %) | Aluminum content (wt %) | Compound | Average grain size (μm) | Residual O, C amounts (wt %) O | C |
|---|---|---|---|---|---|---|
| Fe—Si—Al compound powder | | | | | | |
| 1 | 20.1 | 0.0 | $Fe_2Si(\beta)$ | 6.4 | 0.040 | 0.007 |
| 2 | 33.5 | 0.0 | FeSi(ϵ) | 4.8 | 0.060 | 0.013 |
| 3 | 33.5 | 2.0 | FeSi(ϵ) | 4.9 | 0.090 | 0.017 |

TABLE 21-continued

| Raw material No. | Silicon content (wt %) | Aluminum content (wt %) | Compound | Average grain size (μm) | Residual O, C amounts (wt %) O | C |
|---|---|---|---|---|---|---|
| 4 | 33.5 | 6.0 | FeSi(ϵ) | 4.7 | 0.120 | 0.018 |
| 5 | 50.1 | 1.0 | $FeSi_2$(ζβ) | 3.6 | 0.130 | 0.025 |
| Fe powder | | | | | | |
| 6 | — | — | Fe | 5.8 | 0.240 | 0.023 |

Note: The β, ϵ, and ζβ symbols in the parentheses () in the "Compound" column indicate the type of crystal phase in the Fe–Si compound.

TABLE 22

| Sample No. | Composition (wt %) Fe | Si | Al | Raw material No. | Fe—Si—Al powder and iron powder mixture weights (wt %) Fe—Si—Al (wt %) | Fe (wt %) |
|---|---|---|---|---|---|---|
| Embodiment 5 | | | | | | |
| 1 | 91.7 | 8.3 | 0.0 | 1 | 41.3 | 58.7 |
| 2 | 90.0 | 10.0 | 0.0 | 1 | 29.9 | 70.1 |
| 3 | 88.3 | 11.7 | 0.0 | 2 | 34.9 | 65.1 |
| 4 | 89.4 | 10.0 | 0.6 | 3 | 29.9 | 70.1 |
| 5 | 88.2 | 10.0 | 1.8 | 4 | 29.9 | 70.1 |
| 6 | 89.8 | 10.0 | 0.2 | 5 | 20.0 | 80.0 |

TABLE 23

| Sample No. | Silicon content (wt %) | Aluminum content (wt %) | Average powder grain size (μm) | Residual O, C amounts (wt %) O | C |
|---|---|---|---|---|---|
| Powder raw material | | | | | |
| 7 | 8.3 | 0.0 | 25 | 0.067 | 0.027 |
| 8 | 10.0 | 0.0 | 30 | 0.089 | 0.027 |
| 9 | 11.7 | 0.0 | 28 | 0.103 | 0.030 |
| 10 | 10.0 | 2.0 | 30 | 0.120 | 0.033 |
| 11 | 10.0 | 3.0 | 30 | 0.150 | 0.045 |
| Molten raw material | | | | | |
| 12 | 10.0 | 1.0 | — | 0.004 | 0.001 |

TABLE 24

| | Amount of binder added Polymer | Plasticizer | Water |
|---|---|---|---|
| Embodiment 5 | Polyvinyl alcohol :0.5 wt % | Glycerin :0.1 wt % | Water :54 wt % |

TABLE 25

| No. | Sample No. | Molded body dimensions (mm) | Binder removal conditions Atmosphere | Temperature (° C.) | Time (H) | Sintering conditions Atmosphere | Temperature (° C.) | Time (H) |
|---|---|---|---|---|---|---|---|---|
| Embodiment 5 | | | | | | | | |
| 1 | 1 | 60 × 60 × 1.2 | Vacuum | 500 | 2 | Vacuum | 1200 | 3 |
| 2 | 2 | 60 × 60 × 1.2 | Vacuum | 500 | 2 | Vacuum | 1200 | 3 |
| 3 | 2 | 60 × 60 × 5.8 | Vacuum | 500 | 2 | Vacuum | 1200 | 3 |
| 4 | 2 | 60 × 60 × 11.8 | Vacuum | 500 | 2 | Vacuum | 1200 | 3 |
| 5 | 3 | 60 × 60 × 1.2 | Vacuum | 500 | 2 | Vacuum | 1200 | 3 |
| 6 | 4 | 60 × 60 × 1.2 | Vacuum | 500 | 2 | Vacuum | 1200 | 3 |
| 7 | 5 | 60 × 60 × 1.2 | Vacuum | 500 | 2 | Vacuum | 1200 | 3 |
| 8 | 5 | 60 × 60 × 1.2 | Vacuum | 500 | 2 | Hydrogen | 1200 | 3 |
| 9 | 6 | 60 × 60 × 1.2 | Vacuum | 500 | 2 | Hydrogen | 1200 | 3 |
| 10 | 7 | 60 × 60 × 1.2 | Vacuum | 500 | 2 | Vacuum | 1200 | 3 |
| 11 | 8 | 60 × 60 × 1.2 | Vacuum | 500 | 2 | Hydrogen | 1200 | 3 |
| 12 | 9 | 60 × 60 × 1.2 | Vacuum | 500 | 2 | Vacuum | 1200 | 3 |
| 13 | 10 | 60 × 60 × 1.2 | Vacuum | 500 | 2 | Vacuum | 1200 | 3 |
| 14 | 10 | 60 × 60 × 5.8 | Vacuum | 500 | 2 | Vacuum | 1200 | 3 |
| 15 | 10 | 60 × 60 × 11.8 | Vacuum | 500 | 2 | Vacuum | 1200 | 3 |
| 16 | 11 | 60 × 60 × 1.2 | Vacuum | 500 | 2 | Vacuum | 1200 | 3 |

TABLE 26

| No. | Sample No. | Pre-rolling dimensions (mm) | Parallelism (mm) |
|---|---|---|---|
| Embodiment 5 | | | |
| 1 | 1 | 50 × 50 × 1.0 | 0.33 |
| 2 | 2 | 50 × 50 × 1.0 | 0.34 |
| 3 | 2 | 50 × 50 × 5.0 | 0.18 |
| 4 | 2 | 50 × 50 × 10.0 | 0.12 |
| 5 | 3 | 50 × 50 × 1.0 | 0.37 |
| 6 | 4 | 50 × 50 × 1.0 | 0.32 |
| 7 | 5 | 50 × 50 × 1.0 | 0.34 |
| 8 | 5 | 50 × 50 × 1.0 | 0.36 |
| 9 | 6 | 50 × 50 × 1.0 | 0.30 |
| 10 | 7 | 50 × 50 × 1.0 | 0.34 |
| 11 | 8 | 50 × 50 × 1.0 | 0.30 |
| 12 | 9 | 50 × 50 × 1.0 | 0.35 |
| 13 | 10 | 50 × 50 × 1.0 | 0.37 |
| 14 | 10 | 50 × 50 × 5.0 | 0.17 |
| 15 | 10 | 50 × 50 × 10.0 | 0.12 |
| 16 | 11 | 50 × 50 × 1.0 | 0.37 |
| Embodiment 6 | | | |
| 17 | 12 | 50 × 50 × 5.0 | 0.65 |
| 18 | 12 | 50 × 50 × 5.0 | 0.08 |
| 19 | 12 | 50 × 50 × 5.0 | 0.09 |

Note 1: Parallelism expresses amount of warping per 50 mm in length.
Note 2: Parallelism after surface grinding is noted in embodiment No. 18 and No. 19.
Note 3: In embodiment No. 19, molten steel sheet slow cooled without water cooling is represented.

TABLE 27

| | Residual oxygen and carbon amounts (wt %) | | Average crystal grain size | Relative density |
|---|---|---|---|---|
| | O | C | (μm) | (%) |
| Embodiment 5 | | | | |
| 1 | 0.1800 | 0.007 | 72 | 99 |
| 2 | 0.2100 | 0.007 | 79 | 99 |
| 3 | 0.2100 | 0.007 | 63 | 99 |
| 4 | 0.2100 | 0.007 | 56 | 99 |
| 5 | 0.2200 | 0.008 | 84 | 99 |
| 6 | 0.1700 | 0.010 | 80 | 99 |
| 7 | 0.2000 | 0.010 | 86 | 99 |
| 8 | 0.2100 | 0.010 | 370 | 100 |
| 9 | 0.1800 | 0.010 | 90 | 99 |
| 10 | 0.2000 | 0.012 | 113 | 99 |
| 11 | 0.2000 | 0.012 | 105 | 99 |

TABLE 27-continued

| | Residual oxygen and carbon amounts (wt %) | | Average crystal grain size | Relative density |
|---|---|---|---|---|
| | O | C | (μm) | (%) |
| 12 | 0.1900 | 0.010 | 110 | 99 |
| 13 | 0.2200 | 0.010 | 124 | 99 |
| 14 | 0.2200 | 0.010 | 103 | 99 |
| 15 | 0.2200 | 0.010 | 94 | 99 |
| 16 | 0.2400 | 0.012 | 146 | 99 |
| Embodiment 6 | | | | |
| 17 | 0.004 | 0.001 | 230 | 100 |
| 18 | 0.004 | 0.001 | 230 | 100 |
| 19 | 0.004 | 0.001 | 3400 | 100 |

TABLE 28

| No. | Sample No. | Thickness after rolling (mm) | Relative density (%) | Rolled condition |
|---|---|---|---|---|
| Embodiment 5 | | | | |
| 1 | 1 | 0.1 | 100 | ◎ |
| 2 | 2 | 0.1 | 100 | ◎ |
| 3 | 2 | 0.9 | 100 | ○ |
| 4 | 2 | 0.9 | — | Δ |
| 5 | 3 | 0.1 | 100 | ◎ |
| 6 | 4 | 0.1 | 100 | ◎ |
| 7 | 5 | 0.1 | 100 | ◎ |
| 8 | 5 | 0.1 | 100 | ◎ |
| 9 | 6 | 0.1 | 100 | ◎ |
| 10 | 7 | 0.1 | 100 | ○ |
| 11 | 8 | 0.1 | — | X |
| 12 | 9 | 0.1 | 100 | ◎ |
| 13 | 10 | 0.1 | 100 | ◎ |
| 14 | 10 | 0.9 | 100 | ○ |
| 15 | 10 | 0.9 | — | Δ |
| 16 | 11 | 0.1 | — | X |
| Embodiment 6 | | | | |
| 17 | 12 | 0.9 | — | Δ |
| 18 | 12 | 0.9 | 100 | ◎ |
| 19 | 12 | 0.9 | — | X |

TABLE 29

| No. | Sample No. | Thickness after rolling (mm) | Thickness of vapor-deposited aluminum film (μm) | Annealing conditions: Atmosphere | Diffusion temperature (° C. × 3H) | Grain growing temperature (° C. × 3H) |
|---|---|---|---|---|---|---|
| Embodiment 5 | | | | | | |
| 1 | 1 | 0.1 | 6 | Vacuum | 1050 | 1250 |
| 2 | 2 | 0.1 | 6 | Ar | 1100 | 1250 |
| 3 | 2 | 0.9 | 10 | Ar | 1150 | 1300 |
| 4 | 2 | — | — | — | — | — |
| 5 | 3 | 0.1 | 6 | Ar | 1100 | 1250 |
| 6 | 4 | 0.1 | 5 | Vacuum | 1050 | 1250 |

TABLE 29-continued

| No. | Sample No. | Thickness after rolling (mm) | Thickness of vapor-deposited aluminum film (μm) | Annealing conditions: Atmosphere | Diffusion temperature (° C. × 3H) | Grain growing temperature (° C. × 3H) |
|---|---|---|---|---|---|---|
| 7 | 5 | 0.1 | 10 | Ar | 1150 | 1300 |
| 8 | 5 | — | — | — | — | — |
| 9 | 6 | 0.1 | 5 | Vacuum | 1100 | 1250 |
| 10 | 7 | 0.1 | 6 | Ar | 1150 | 1250 |
| 11 | 8 | — | — | — | — | — |
| 12 | 9 | 0.1 | 7 | Ar | 1150 | 1250 |
| 13 | 10 | 0.1 | 8 | Vacuum | 1100 | 1300 |
| 14 | 10 | 0.9 | 5 | Vacuum | 1100 | 1250 |
| 15 | 10 | — | — | — | — | — |
| 16 | 11 | — | — | — | — | — |
| Embodiment 6 | | | | | | |
| 17 | 12 | — | — | — | — | — |
| 18 | 12 | 0.6 | 10 | Ar | 1150 | 1300 |
| 19 | 12 | — | — | — | — | — |
| Comparison | | | | | | |
| 20 | — | — | — | — | — | — |
| 21 | — | — | — | — | — | — |

TABLE 30

| No. | Average crystal grain size (mm) | Si, Al composition: Si (wt %) | Al (wt %) | Magnetic properties: $\mu_i$ | Bs(T) | iHc(Oe) |
|---|---|---|---|---|---|---|
| Embodiment 5 | | | | | | |
| 1 | 1.5 | 8.0 | 2.1 | 4500 | 1.31 | 0.09 |
| 2 | 1.3 | 9.7 | 2.1 | 4700 | 1.14 | 0.09 |
| 3 | 2.1 | 10.0 | 0.4 | 3200 | 1.28 | 0.13 |
| 4 | — | — | — | — | — | — |
| 5 | 1.5 | 9.7 | 2.1 | 4000 | 1.24 | 0.10 |
| 6 | 1.8 | 9.8 | 2.4 | 5700 | 1.18 | 0.09 |
| 7 | 2.4 | 9.6 | 5.4 | 28000 | 1.09 | 0.03 |
| 8 | — | — | — | — | — | — |
| 9 | 1.7 | 9.9 | 2.0 | 4700 | 1.20 | 0.08 |
| 10 | 1.7 | 8.0 | 2.1 | 4500 | 1.31 | 0.09 |
| 11 | — | — | — | — | — | — |
| 12 | 1.8 | 11.0 | 2.4 | 5000 | 1.17 | 0.08 |
| 13 | 2.8 | 9.7 | 4.9 | 18000 | 1.10 | 0.04 |
| 14 | 1.6 | 9.9 | 2.4 | 5200 | 1.18 | 0.07 |
| 15 | — | — | — | — | — | — |
| 16 | — | — | — | — | — | — |
| Embodiment 6 | | | | | | |
| 17 | — | — | — | — | — | — |
| 18 | 2.5 | 9.8 | 2.1 | 4800 | 1.11 | 0.08 |
| 19 | — | — | — | — | — | — |
| Comparison | | | | | | |
| 20 | — | 6.5 | — | 3000 | 1.22 | 0.14 |
| 21 | — | 9.6 | 5.4 | 32000 | 1.09 | 0.03 |

Embodiment 7

For the raw material powder for sintered silicon steel sheet, high-frequency melting was done and ingots were made to form the Fe—Si compounds and Fe—Si—Al compounds noted in Table 31. These ingots were then coarse-crushed and jet-mill pulverized to make powders having the average grain sizes noted in Table 31.

For the steel powder, carbonyl iron powder having the composition and average grain size noted in Table 31 was used. The Fe—Si compounds or Fe—Si—Al compounds were mixed with the carbonyl iron powder in the proportions noted in Tablet 32 and then mixed together in a V cone.

For the powders of the desired composition, moreover, gas-atomized powders having the compositions and average grain sizes noted in Table 33 were used. To the raw material powders were added a PVA (polyvinyl alcohol) binder, water, and plasticizer, in the amounts indicated in Table 24 to make slurries. These slurries were pulverized with a completely sealed spray drier apparatus, using nitrogen gas, with the hot gas inlet temperature set at 100° C. and the outlet temperature set at 40° C.

After green-molding the granulated powders having an average grain size of approximately 80 μm with a compression press under a pressure of 2 tons/cm$^2$ to the shapes noted in Table 34, binder removal and sintering at sintering temperatures as noted in Table 34 were performed in a vacuum to yield sintered bodies having the dimensions noted in Table 35. The parallelism (in Table 35), ratio of iron-rich phase contained, residual oxygen amounts, residual carbon amounts, average crystal grain sizes, and relative densities in or of the sintered bodies obtained are listed in Table 36. The iron-rich phase content ratio was evaluated relatively according to the ratio between the maximum X-ray diffraction strength characteristic of the Fe—Si compound and the (110) diffraction strength of the silicon steel having a body centered cubic structure (bcc).

After cold-rolling the sintered bodies having the dimensions listed in Table 35 with two-stage rollers having outer diameters of 60 mm at a roller circumferential speed of 60 mm/sec until a rolling ration of 50% was attained, cold rolling was performed with four-stage rollers having outer diameters of 20 mm at the same roller circumferential speed, down to the thicknesses indicated in Table 37. The rolled conditions are listed in Table 37.

After rolling, 20 Ø×10 Ø rings were punched out, aluminum was vacuum-deposited on both sides of the steel sheet in the thicknesses noted in Table 38, heat treatment was performed at the annealing temperatures indicated in Table 38, and the DC magnetic properties were measured. The results are noted in Table 39. The rolled conditions noted in Table 37 are the same as in the first embodiment. As an example for magnetic property comparison, the magnetic properties of ordinary Fe-6.5Si and sendust alloy ingot material are noted in Table 39.

TABLE 31

| Raw material No. | Silicon content (wt %) | Aluminum content (wt %) | Compound | Average grain size (μm) | Residual O, C amounts (wt %) O | C |
|---|---|---|---|---|---|---|
| Fe—Si—Al compound powder | | | | | | |
| 1 | 20.1 | 0.0 | $Fe_2Si(\beta)$ | 6.4 | 0.040 | 0.007 |
| 2 | 33.5 | 0.0 | FeSi(ϵ) | 4.8 | 0.060 | 0.013 |
| 3 | 33.5 | 2.0 | FeSi(ϵ) | 4.9 | 0.090 | 0.017 |
| 4 | 33.5 | 6.0 | FeSi(ϵ) | 4.7 | 0.120 | 0.018 |
| 5 | 50.1 | 1.0 | $FeSi_2(\zeta\beta)$ | 3.6 | 0.130 | 0.025 |
| Fe powder | | | | | | |
| 6 | — | — | Fe | 5.8 | 0.240 | 0.023 |

Note:
The β, ϵ, and ζβ symbols in the parentheses ( ) in the "Compound" column indicate the type of crystal phase in the Fe—Si compound.

TABLE 32

| Sample No. | Composition (wt %) Fe | Si | Al | Fe—Si—La compound powder and iron powder mixture weights(wt %) No. | Fe—Si—Al(wt %) | Fe(wt %) |
|---|---|---|---|---|---|---|
| Embodiment 7 | | | | | | |
| 1 | 91.7 | 8.3 | 0.0 | 1 | 41.3 | 58.7 |
| 2 | 90.0 | 10.0 | 0.0 | 1 | 29.9 | 70.1 |
| 3 | 88.3 | 11.7 | 0.0 | 2 | 34.9 | 65.1 |
| 4 | 89.4 | 10.0 | 0.6 | 3 | 29.9 | 70.1 |
| 5 | 88.2 | 10.0 | 1.8 | 4 | 29.9 | 70.1 |
| 6 | 89.8 | 10.0 | 0.2 | 5 | 20.0 | 80.0 |

TABLE 33

| | Sample No. | Silicon content (wt %) | Aluminum content (wt %) | Average powder grain size (μm) | Residual O,C amounts (wt %) O | C |
|---|---|---|---|---|---|---|
| Powder raw material | 7 | 8.3 | 0.0 | 25 | 0.067 | 0.027 |
| | 8 | 10.0 | 0.0 | 30 | 0.089 | 0.027 |
| | 9 | 11.7 | 0.0 | 28 | 0.103 | 0.030 |
| | 10 | 10.0 | 2.0 | 30 | 0.120 | 0.033 |
| | 11 | 10.0 | 3.0 | 30 | 0.150 | 0.045 |
| Molten raw material | 12 | 10.0 | 1.0 | — | 0.004 | 0.001 |

TABLE 34

| No. | Sample No. | Molded body dimensions (mm) | Binder removal conditions Atmosphere | Temperature (° C.) | Time (H) | Sintering conditions Atmosphere | Temperature (° C.) | Time (H) |
|---|---|---|---|---|---|---|---|---|
| Embodiment 7 | | | | | | | | |
| 1 | 1 | 60 × 60 × 1.2 | Vacuum | 500 | 2 | Vacuum | 1150 | 3 |
| 2 | 2 | 60 × 60 × 1.2 | Vacuum | 500 | 2 | Vacuum | 1150 | 3 |
| 3 | 2 | 60 × 60 × 5.8 | Vacuum | 500 | 2 | Vacuum | 1150 | 3 |
| 4 | 2 | 60 × 60 × 11.8 | Vacuum | 500 | 2 | Vacuum | 1100 | 3 |
| 5 | 3 | 60 × 60 × 1.2 | Vacuum | 500 | 2 | Vacuum | 1100 | 3 |
| 6 | 4 | 60 × 60 × 1.2 | Vacuum | 500 | 2 | Vacuum | 1100 | 3 |
| 7 | 5 | 60 × 60 × 1.2 | Vacuum | 500 | 2 | Vacuum | 1100 | 3 |
| 8 | 5 | 60 × 60 × 1.2 | Vacuum | 500 | 2 | Hydrogen | 1200 | 3 |
| 9 | 6 | 60 × 60 × 1.2 | Vacuum | 500 | 2 | Hydrogen | 1100 | 3 |
| 10 | 7 | 60 × 60 × 1.2 | Vacuum | 500 | 2 | Vacuum | 1150 | 3 |
| 11 | 8 | 60 × 60 × 1.2 | Vacuum | 500 | 2 | Hydrogen | 1150 | 3 |
| 12 | 9 | 60 × 60 × 1.2 | Vacuum | 500 | 2 | Vacuum | 1150 | 3 |
| 13 | 10 | 60 × 60 × 1.2 | Vacuum | 500 | 2 | Vacuum | 1150 | 3 |
| 14 | 10 | 60 × 60 × 5.8 | Vacuum | 500 | 2 | Vacuum | 1150 | 3 |
| 15 | 10 | 60 × 60 × 11.8 | Vacuum | 500 | 2 | Vacuum | 1150 | 3 |
| 16 | 11 | 60 × 60 × 1.2 | Vacuum | 500 | 2 | Vacuum | 1150 | 3 |

TABLE 35

| No. | Sample No. | Pre-rolling dimensions (mm) | Parallelism (mm) |
|---|---|---|---|
| Embodiment 7 | | | |
| 1 | 1 | 50 × 50 × 1.0 | 0.30 |
| 2 | 2 | 50 × 50 × 1.0 | 0.31 |
| 3 | 2 | 50 × 50 × 5.0 | 0.15 |
| 4 | 2 | 50 × 50 × 10.0 | 0.09 |
| 5 | 3 | 50 × 50 × 1.0 | 0.34 |
| 6 | 4 | 50 × 50 × 1.0 | 0.28 |
| 7 | 5 | 50 × 50 × 1.0 | 0.30 |
| 8 | 5 | 50 × 50 × 1.0 | 0.32 |
| 9 | 6 | 50 × 50 × 1.0 | 0.25 |
| 10 | 7 | 50 × 50 × 1.0 | 0.32 |
| 11 | 8 | 50 × 50 × 1.0 | 0.29 |
| 12 | 9 | 50 × 50 × 1.0 | 0.31 |
| 13 | 10 | 50 × 50 × 1.0 | 0.34 |
| 14 | 10 | 50 × 50 × 5.0 | 0.14 |
| 15 | 10 | 50 × 50 × 10.0 | 0.10 |
| 16 | 11 | 50 × 50 × 1.0 | 0.51 |

Note 1: Parallelism expresses amount of warping per 50 mm in length.

TABLE 36

| No. | Residual oxygen and carbon amounts (wt %) O | C | Average crystal grain size (μm) | X-ray diffusion strength ratio | Relative density (%) |
|---|---|---|---|---|---|
| Embodiment 7 | | | | | |
| 1 | 0.1500 | 0.007 | 51 | 0.010 | 93 |
| 2 | 0.1600 | 0.006 | 58 | 0.010 | 93 |
| 3 | 0.1700 | 0.007 | 46 | 0.010 | 93 |
| 4 | 0.1600 | 0.008 | 41 | 0.012 | 90 |
| 5 | 0.1600 | 0.008 | 62 | 0.014 | 90 |
| 6 | 0.1700 | 0.009 | 60 | 0.012 | 91 |
| 7 | 0.1800 | 0.009 | 65 | 0.010 | 91 |
| 8 | 0.0850 | 0.001 | 350 | 0.001 | 94 |

TABLE 36-continued

| No. | Residual oxygen and carbon amounts (wt %) O | C | Average crystal grain size (μm) | X-ray diffusion strength ratio | Relative density (%) |
|---|---|---|---|---|---|
| 9 | 0.0810 | 0.001 | 63 | 0.012 | 90 |
| 10 | 0.1800 | 0.012 | 70 | 0.008 | 92 |
| 11 | 0.0750 | 0.001 | 68 | 0.007 | 93 |
| 12 | 0.1900 | 0.007 | 71 | 0.008 | 92 |
| 13 | 0.3000 | 0.007 | 74 | 0.006 | 93 |
| 14 | 0.1800 | 0.007 | 62 | 0.008 | 92 |
| 15 | 0.1900 | 0.007 | 64 | 0.007 | 92 |
| 16 | 0.1800 | 0.006 | 85 | 0.007 | 93 |

TABLE 37

| No. | Sample No. | Thickness after rolling (mm) | Relative density (%) | Rolled condition |
|---|---|---|---|---|
| Embodiment 7 | | | | |
| 1 | 1 | 0.1 | 100 | ◎ |
| 2 | 2 | 0.1 | 100 | ◎ |
| 3 | 2 | 0.9 | 100 | ○ |
| 4 | 2 | 0.9 | — | Δ |
| 5 | 3 | 0.1 | 100 | ◎ |
| 6 | 4 | 0.1 | 100 | ◎ |
| 7 | 5 | 0.1 | 100 | ◎ |
| 8 | 5 | 0.1 | 100 | ◎ |
| 9 | 6 | 0.1 | 100 | ◎ |
| 10 | 7 | 0.1 | 100 | ○ |
| 11 | 8 | 0.1 | — | X |
| 12 | 9 | 0.1 | 100 | ◎ |
| 13 | 10 | 0.1 | 100 | ◎ |
| 14 | 10 | 0.9 | 100 | ○ |
| 15 | 10 | 0.9 | — | Δ |
| 16 | 11 | 0.1 | — | X |

TABLE 38

| No. | Sample No. | Thickness after rolling (mm) | Thickness of deposited aluminum film (μm) | Annealing conditions Atmosphere | Diffusion temperature (° C. × 3H) | Grain growing temperature (° C. × 3H) |
|---|---|---|---|---|---|---|
| Embodiment 7 | | | | | | |
| 1 | 1 | 0.1 | 6 | Vacuum | 1050 | 1250 |
| 2 | 2 | 0.1 | 6 | Ar | 1100 | 1250 |
| 3 | 2 | 0.9 | 10 | Ar | 1150 | 1300 |
| 4 | 2 | — | — | — | — | — |
| 5 | 3 | 0.1 | 6 | Ar | 1100 | 1250 |
| 6 | 4 | 0.1 | 5 | Vacuum | 1050 | 1250 |
| 7 | 5 | 0.1 | 10 | Ar | 1150 | 1300 |
| 8 | 5 | 0.1 | 10 | Vacuum | 1150 | 1300 |
| 9 | 6 | 0.1 | 5 | Vacuum | 1100 | 1250 |
| 10 | 7 | 0.1 | 6 | Ar | 1150 | 1250 |
| 11 | 8 | — | — | — | — | — |
| 12 | 9 | 0.1 | 7 | Ar | 1150 | 1250 |
| 13 | 10 | 0.1 | 8 | Vacuum | 1100 | 1300 |
| 14 | 10 | 0.9 | 5 | Vacuum | 1100 | 1250 |
| 15 | 10 | — | — | — | — | — |
| 16 | 11 | — | — | — | — | — |

TABLE 39

| No. | Average crystal grain size (mm) | Si, Al composition Si(wt %) | Al(wt %) | Magnetic properties $\mu_i$ | Bs(T) | iHc(Oe) |
|---|---|---|---|---|---|---|
| Embodiment 7 | | | | | | |
| 1 | 1.6 | 8.0 | 2.1 | 4500 | 1.31 | 0.09 |
| 2 | 1.4 | 9.7 | 2.0 | 4500 | 1.14 | 0.10 |
| 3 | 2.4 | 10.0 | 0.4 | 3200 | 1.28 | 0.13 |
| 4 | — | — | — | — | — | — |
| 5 | 1.6 | 11.0 | 2.1 | 2800 | 1.18 | 0.15 |
| 6 | 1.7 | 9.8 | 2.4 | 5800 | 1.18 | 0.09 |
| 7 | 2.6 | 9.6 | 5.4 | 28000 | 1.09 | 0.03 |
| 8 | — | — | — | — | — | — |
| 9 | 1.5 | 9.9 | 2.0 | 4700 | 1.20 | 0.08 |
| 10 | 1.5 | 8.0 | 2.1 | 4500 | 1.31 | 0.09 |
| 11 | — | — | — | — | — | — |
| 12 | 2.0 | 11.0 | 2.4 | 5000 | 1.17 | 0.08 |
| 13 | 3.1 | 9.7 | 5.0 | 19000 | 1.10 | 0.03 |
| 14 | 1.7 | 9.9 | 2.4 | 5200 | 1.18 | 0.07 |
| 15 | — | — | — | — | — | — |
| 16 | — | — | — | — | — | — |
| Comparison | | | | | | |
| 20 | — | 6.5 | — | 3000 | 1.22 | 0.14 |
| 21 | — | 9.6 | 5.4 | 32000 | 1.09 | 0.03 |

INDUSTRIAL APPLICABILITY

Conventionally, silicon steel having 3 wt % or more of silicon in the iron has been considered impossible to cold-roll because, in general, the average crystal grain size is large, on the order of several mm. With the manufacturing method of the present invention, however, by employing a powder metallurgy fabrication process using powder as the starting raw material and making the average crystal grain size of a sheet-form sintered body or quick-cooled steel sheet 300 μm or less, after crystal grain boundary slip transformation, intra-grain slip transformation occurs, wherefore cold rolling is made possible. Furthermore, by fabricating a mixed powder wherein pure iron powder and Fe—Si powder are mixed together in a prescribed portion with a powder metallurgy technique, and causing an iron-rich phase to remain in the sintered body, cold rolling is made possible using the plastic transformation of those crystal grains. Moreover, it is evident that, when a minute amount of a non-magnetic metal element such as Ti, V, or Al is added, crystal grain growth can be promoted during annealing, the magnetic properties of the thin steel sheet become almost the same as that of conventional ingot material, and silicon steel sheet exhibiting outstanding magnetic properties can beg fabricated.

With the rolled silicon steel sheet according to the present invention, the average crystal grain size is made minute, or iron powder and Fe—Si compound powder is mixed in a prescribed proportion, an iron-rich phase is caused to remain during sintering, the sheet thickness is made thin prior to rolling, and the parallelism thereof is enhanced, thereby making it possible to perform cold rolling and punch machining, and directionality is also exhibited, wherefore, after annealing, outstanding magnetic properties are exhibited which are the same as conventional ingot material. Accordingly, in the future, the applications therefor can be broadened over a wide range to transformers and yoke elements, etc.

With the present invention, moreover, by adding lanthanum to the silicon steel and causing lanthanum oxides to be deposited in the crystal grain boundaries, electrical resistivity can be manifested at a high level that is from several times to nearly ten times higher than when no such addition is made. Thus particularly desirable properties can be provided in materials for units requiring low eddy current loss in the face of magnetic fields alternating at high frequency, such as high-frequency transformer cores and the like.

With the present invention, furthermore, using the rolled silicon steel sheet of the present invention made amenable to cold rolling, after vapor-depositing aluminum, to both sides of the rolled thin sheet, when heat treatment is performed to cause the aluminum to diffuse and permeate to the interior of that thin sheet and the crystal grain size is simultaneously. coarsened, thin sendust sheet is obtained which exhibits the same outstanding magnetic properties as ingot material, and extremely thin sendust sheet can be easily mass produced. It is foreseen that this thin sendust sheet will see dramatically expanding applications over a wide range that includes-transformers and yoke elements, etc.

What is claimed is:

1. A method for manufacturing Fe—Si alloy steel comprising the steps of:

providing a sintered body of Fe—Si alloy steel having a silicon content of 3 to 10 wt %, an average crystal grain size of 300 μm or less and a thickness of 5 mm or less;

cold-rolling said sintered body to provide a cold-rolled sintered body; and annealing said cold-rolled sintered body.

2. A method for manufacturing Fe—Si alloy steel comprising the steps of:

providing a melt ingot of Fe—Si alloy steel having a silicon content of 3 to 10 wt %, an average crystal grain size of 300 μm or less and a thickness of 5 mm or less;

cold-rolling said melt ingot to provide a cold-rolled melt ingot; and annealing said cold-rolled melt ingot.

3. The method for manufacturing Fe—Si alloy steel according to claims 1 or 2, wherein said sintered body or melt ingot contains 0.05 wt % to 2.0 wt % of lanthanum.

4. The method for manufacturing Fe—Si alloy steel according to claims 1 or 2, wherein said sintered body or melt ingot contains 0.01 to 1.0 wt % in single or compound Ti, Al, V.

5. The method for manufacturing Fe—Si alloy steel according to claim 1, wherein said sintered body is fabricated by a powder metallurgy method wherein sintering is performed after molding by powder injection molding, green molding, or slip-casting, or by a hot former and plasma sintering.

6. The method for manufacturing Fe—Si alloy steel according to claim 2, wherein said melt ingot is cast by making Fe—Si alloy steel to flow into a water-cooled casting mold having a casting thickness of 5 mm or less.

* * * * *